US007053774B2

(12) United States Patent
Sedon et al.

(10) Patent No.: US 7,053,774 B2
(45) Date of Patent: May 30, 2006

(54) ALARMING MERCHANDISE DISPLAY SYSTEM

(75) Inventors: Nicholas M. Sedon, Weddington, NC (US); Michael S. Jaeb, Millersburg, OH (US); Ronald M. Marsilio, Lake Wiley, SC (US)

(73) Assignee: Alpha Security Products, Inc., Charlotte, NC (US)

( * ) Notice: Subject to any disclaimer, the term of this patent is extended or adjusted under 35 U.S.C. 154(b) by 0 days.

(21) Appl. No.: 10/939,069

(22) Filed: Sep. 10, 2004

(65) Prior Publication Data

US 2005/0073413 A1 Apr. 7, 2005

Related U.S. Application Data

(60) Provisional application No. 60/503,102, filed on Sep. 12, 2003, provisional application No. 60/592,899, filed on Jul. 30, 2004.

(51) Int. Cl.
*G08B 13/14* (2006.01)

(52) U.S. Cl. ..... 340/568.2; 70/62; 206/807; 248/551; 340/568.8

(58) Field of Classification Search ..... 340/568.2, 340/568.8, 568.1, 571, 687, 542; 211/26–26.2; 248/551, 553; 70/57.1, 58, 62; 206/807, 206/1.5

See application file for complete search history.

(56) References Cited

U.S. PATENT DOCUMENTS

| | | | |
|---|---|---|---|
| 883,335 | A | 3/1908 | O'Conner |
| 1,238,532 | A | 8/1917 | Lemberg |
| 1,351,367 | A | 8/1920 | Bowman |
| 1,587,437 | A | 6/1926 | Sturge |
| 1,748,283 | A | 2/1930 | Filby |
| 1,765,223 | A | 6/1930 | Ferris |
| 2,474,157 | A | 6/1949 | Needlman |
| 2,591,438 | A | 4/1952 | Kinman et al. |
| 2,626,388 | A | 1/1953 | Needlman |
| 2,780,689 | A | 2/1957 | La Cavera |
| 2,821,453 | A | 1/1958 | Jessen |
| 2,821,579 | A | 1/1958 | Benjamin |
| 2,856,517 | A | 10/1958 | Steglich |
| 2,912,525 | A | 11/1959 | Ures |
| 2,937,396 | A | 5/1960 | Momberg et al. |
| 3,044,631 | A | 7/1962 | Greenman et al. |
| 3,127,597 | A | 3/1964 | Lewin et al. |
| 3,216,586 | A | 11/1965 | Sand |
| 3,226,172 | A | 12/1965 | Bateman |
| 3,253,270 | A | 5/1966 | Downer |
| 3,316,361 | A | 4/1967 | Thompson |
| 3,336,892 | A | 8/1967 | Barry et al. |
| 3,366,944 | A | 1/1968 | Cochran |
| 3,426,282 | A | 2/1969 | Brady |
| 3,440,636 | A | 4/1969 | Sliman |

(Continued)

FOREIGN PATENT DOCUMENTS

| | | |
|---|---|---|
| DE | 3518157 | 11/1986 |

(Continued)

*Primary Examiner*—Thomas Mullen
(74) *Attorney, Agent, or Firm*—Sand & Sebolt

(57) ABSTRACT

A display system for displaying an item of merchandise in a retail environment that allows a potential customer to handle the item while it is secured to the display system. The item is supported on a display shelf and is connected to a retractable cable. The shelf is locked to a base by an alarm unit. Unauthorized removal of the shelf, base, item of merchandise, severing of the retractable cable or alarm unit will activate an alarm. First and second locks lock the alarm unit to the base.

21 Claims, 25 Drawing Sheets

U.S. PATENT DOCUMENTS

| | | | | |
|---|---|---|---|---|
| 3,444,547 | A | | 5/1969 | Surek |
| 3,596,265 | A | | 7/1971 | Garland |
| 3,617,659 | A | | 11/1971 | Freeman |
| 3,636,547 | A | | 1/1972 | Brace et al. |
| 3,657,491 | A | | 4/1972 | Ryder et al. |
| 3,668,681 | A | * | 6/1972 | Kaplan ..... 340/537 |
| 3,685,037 | A | | 8/1972 | Bennett et al. |
| 3,705,962 | A | | 12/1972 | Banister |
| 3,773,987 | A | | 11/1973 | Davis et al. |
| 3,781,861 | A | | 12/1973 | Adler, Jr. et al. |
| 3,782,654 | A | | 1/1974 | Kasa |
| 3,786,927 | A | | 1/1974 | Manheim |
| 3,801,055 | A | | 4/1974 | Stenger |
| 3,803,577 | A | | 4/1974 | Peterson, II |
| 3,812,307 | A | | 5/1974 | Wagner et al. |
| 3,824,540 | A | | 7/1974 | Smith, II |
| 3,836,007 | A | | 9/1974 | Rosenwein |
| 3,850,392 | A | | 11/1974 | Gassaway |
| 3,858,011 | A | | 12/1974 | Salvin et al. |
| 3,879,721 | A | | 4/1975 | Yereance |
| 3,893,095 | A | | 7/1975 | DeJong |
| 3,929,210 | A | | 12/1975 | Cutler et al. |
| 3,931,949 | A | | 1/1976 | Waligorski et al. |
| 3,932,857 | A | | 1/1976 | Way et al. |
| 3,972,039 | A | | 7/1976 | Marshall |
| 4,008,791 | A | | 2/1977 | Shafii-Kahany et al. |
| 4,057,986 | A | | 11/1977 | Zolke et al. |
| 4,066,231 | A | | 1/1978 | Bahner et al. |
| 4,069,919 | A | | 1/1978 | Fernbaugh |
| 4,141,438 | A | | 2/1979 | Diem |
| 4,150,371 | A | | 4/1979 | Seaglione |
| 4,151,506 | A | | 4/1979 | Schoenmetz |
| 4,151,521 | A | | 4/1979 | Wirth, Jr. |
| 4,155,457 | A | | 5/1979 | Wilbert |
| 4,211,995 | A | | 7/1980 | Smith |
| 4,274,088 | A | | 6/1981 | Pierson et al. |
| 4,293,852 | A | | 10/1981 | Rogers |
| 4,316,181 | A | * | 2/1982 | Primont et al. ..... 340/571 |
| 4,332,204 | A | | 6/1982 | Hewell |
| 4,340,884 | A | | 7/1982 | Maizland |
| 4,384,688 | A | | 5/1983 | Smith |
| 4,444,322 | A | | 4/1984 | Lee |
| 4,455,464 | A | | 6/1984 | Leyden |
| 4,472,010 | A | | 9/1984 | Parnello |
| 4,485,278 | A | | 11/1984 | Schaller et al. |
| 4,499,341 | A | | 2/1985 | Boyd |
| 4,533,796 | A | | 8/1985 | Engelmore |
| 4,546,345 | A | | 10/1985 | Naito |
| 4,583,700 | A | | 4/1986 | Tschurbanoff |
| 4,583,797 | A | | 4/1986 | Engelmore et al. |
| 4,616,113 | A | | 10/1986 | Jank et al. |
| 4,620,182 | A | | 10/1986 | Keifer |
| 4,620,183 | A | | 10/1986 | Kottelman |
| 4,623,765 | A | | 11/1986 | Leyden |
| 4,633,235 | A | | 12/1986 | DeGennaro |
| 4,646,987 | A | | 3/1987 | Peterson |
| 4,655,352 | A | | 4/1987 | Noyes et al. |
| 4,663,611 | A | | 5/1987 | Humphrey |
| 4,673,228 | A | | 6/1987 | Ditzig |
| 4,698,615 | A | | 10/1987 | Wilber |
| 4,746,766 | A | | 5/1988 | Soulard |
| 4,757,955 | A | | 7/1988 | Simmons |
| 4,772,878 | A | | 9/1988 | Kane |
| 4,819,015 | A | | 4/1989 | Bullivant et al. |
| 4,842,108 | A | | 6/1989 | Anderson et al. |
| 4,896,140 | A | | 1/1990 | Biever et al. |
| 4,901,938 | A | | 2/1990 | Cantley et al. |
| 4,989,805 | A | | 2/1991 | Burke |
| 4,993,561 | A | | 2/1991 | Stultz |
| 5,003,292 | A | | 3/1991 | Harding et al. |
| 5,008,487 | A | | 4/1991 | Shimmyo |
| 5,066,942 | A | | 11/1991 | Matsuo |
| 5,072,213 | A | | 12/1991 | Close |
| 5,094,396 | A | | 3/1992 | Burke |
| 5,103,984 | A | | 4/1992 | Leyden et al. |
| 5,114,091 | A | | 5/1992 | Peterson et al. |
| 5,124,685 | A | | 6/1992 | Rankin |
| 5,146,205 | A | | 9/1992 | Keifer et al. |
| 5,154,072 | A | | 10/1992 | Leyden |
| 5,160,048 | A | | 11/1992 | Leyden et al. |
| 5,172,098 | A | | 12/1992 | Leyden et al. |
| 5,177,352 | A | | 1/1993 | Carson et al. |
| 5,196,827 | A | | 3/1993 | Allen et al. |
| D335,439 | S | | 5/1993 | Leyden et al. |
| 5,229,749 | A | | 7/1993 | Yenglin |
| 5,230,481 | A | | 7/1993 | Wheeler et al. |
| 5,241,297 | A | | 8/1993 | Goodman |
| 5,246,183 | A | | 9/1993 | Leyden |
| 5,274,353 | A | | 12/1993 | Bianchi |
| 5,279,135 | A | | 1/1994 | Leyden et al. |
| 5,289,559 | A | | 2/1994 | Wilson |
| 5,331,306 | A | | 7/1994 | Carruthers, II |
| 5,332,171 | A | | 7/1994 | Steff |
| 5,341,124 | A | | 8/1994 | Leyden et al. |
| 5,345,219 | A | | 9/1994 | Rogers |
| 5,345,220 | A | | 9/1994 | Wachsman |
| 5,408,212 | A | | 4/1995 | Meyers et al. |
| 5,418,521 | A | | 5/1995 | Read |
| 5,421,667 | A | | 6/1995 | Leyden et al. |
| 5,462,318 | A | | 10/1995 | Cooke |
| 5,467,075 | A | | 11/1995 | Rand |
| 5,471,197 | A | | 11/1995 | McCurdy et al. |
| 5,535,960 | A | | 7/1996 | Showronski et al. |
| 5,541,578 | A | | 7/1996 | Lussey |
| 5,543,782 | A | | 8/1996 | Rothbaum et al. |
| 5,544,836 | A | | 8/1996 | Pera |
| 5,552,771 | A | | 9/1996 | Leyden et al. |
| 5,561,417 | A | | 10/1996 | Rothbaum et al. |
| 5,565,848 | A | | 10/1996 | Leyden et al. |
| 5,570,080 | A | | 10/1996 | Inoue et al. |
| 5,574,430 | A | | 11/1996 | Ott et al. |
| 5,577,855 | A | | 11/1996 | Leyden et al. |
| 5,594,419 | A | | 1/1997 | Lo |
| 5,604,484 | A | | 2/1997 | Rogers |
| 5,675,998 | A | | 10/1997 | Monteiro |
| 5,676,258 | A | | 10/1997 | Leyden et al. |
| 5,692,721 | A | | 12/1997 | Roberts |
| 5,723,815 | A | | 3/1998 | Pena |
| D393,410 | S | | 4/1998 | Burke et al. |
| 5,787,738 | A | * | 8/1998 | Brandt et al. ..... 70/58 |
| 5,796,337 | A | | 8/1998 | Wachsman |
| 5,802,987 | A | | 9/1998 | Bellak et al. |
| 5,821,857 | A | | 10/1998 | Rand |
| 5,821,868 | A | | 10/1998 | Kuhling |
| 5,823,358 | A | | 10/1998 | Leyden et al. |
| 5,823,368 | A | | 10/1998 | Burke et al. |
| 5,861,807 | A | | 1/1999 | Leyden et al. |
| 5,886,633 | A | | 3/1999 | Adams |
| 5,910,768 | A | | 6/1999 | Ott |
| 5,936,525 | A | | 8/1999 | Leyden et al. |
| 5,943,966 | A | | 8/1999 | Machado et al. |
| 5,949,335 | A | | 9/1999 | Maynard |
| 5,960,651 | A | | 10/1999 | Tanisawa |
| 5,988,409 | A | | 11/1999 | Gusdorf et al. |
| 6,019,304 | A | | 2/2000 | Skowronski et al. |
| 6,027,277 | A | | 2/2000 | Leyden et al. |
| 6,037,867 | A | | 3/2000 | Joseph et al. |
| 6,039,496 | A | | 3/2000 | Bishop |
| 6,039,498 | A | | 3/2000 | Leyden et al. |
| 6,072,393 | A | | 6/2000 | Todd |
| 6,087,939 | A | | 7/2000 | Leyden et al. |
| 6,095,156 | A | | 8/2000 | Smith, II |
| 6,104,289 | A | | 8/2000 | Rand |
| 6,111,505 | A | | 8/2000 | Wagener |

6,140,923 A 10/2000 Lam
6,147,603 A 11/2000 Rand
6,150,940 A 11/2000 Chapman et al.
6,177,869 B1 1/2001 McDaid
6,215,400 B1 4/2001 Rand et al.
6,255,958 B1 7/2001 Haimovich et al.
6,278,365 B1 8/2001 Kane et al.
6,285,283 B1 9/2001 Rand et al.
6,300,874 B1 10/2001 Rand
6,310,550 B1 10/2001 Wagener
6,337,633 B1 1/2002 Foseide
RE37,590 E 3/2002 Leyden et al.
6,353,389 B1 3/2002 Matsuo
6,372,988 B1 4/2002 Burke et al.
6,375,109 B1 4/2002 Liao
6,380,855 B1 4/2002 Ott
6,386,906 B1 5/2002 Burke
6,396,401 B1 5/2002 Matsuo
6,400,269 B1 6/2002 Savastano
6,459,374 B1 10/2002 Rand et al.
6,462,668 B1 10/2002 Foseide
6,476,717 B1 11/2002 Gross et al.
6,495,756 B1 12/2002 Burke et al.
6,560,710 B1 5/2003 Leyden et al.
6,564,953 B1 5/2003 Ascik
6,570,502 B1 5/2003 Matsuo
6,571,969 B1 6/2003 Larbaletier
6,578,683 B1 6/2003 Burke et al.
6,581,421 B1 6/2003 Chmela et al.
6,626,119 B1 9/2003 Wilton
6,679,189 B1 1/2004 Henningfeld
6,698,597 B1 3/2004 Marihugh
6,700,488 B1 3/2004 Leyden et al.
6,831,560 B1 * 12/2004 Gresset ..... 340/568.2
2003/0075603 A1 * 4/2003 Rudduck ..... 235/385
2004/0150524 A1 * 8/2004 Bonato ..... 340/568.2
2005/0161420 A1 * 7/2005 Hardy et al. ..... 211/189

FOREIGN PATENT DOCUMENTS

EP 0 063 313 10/1982
EP 0 516 476 10/1997
FR 2 549 308 1/1985

* cited by examiner

FIG-3
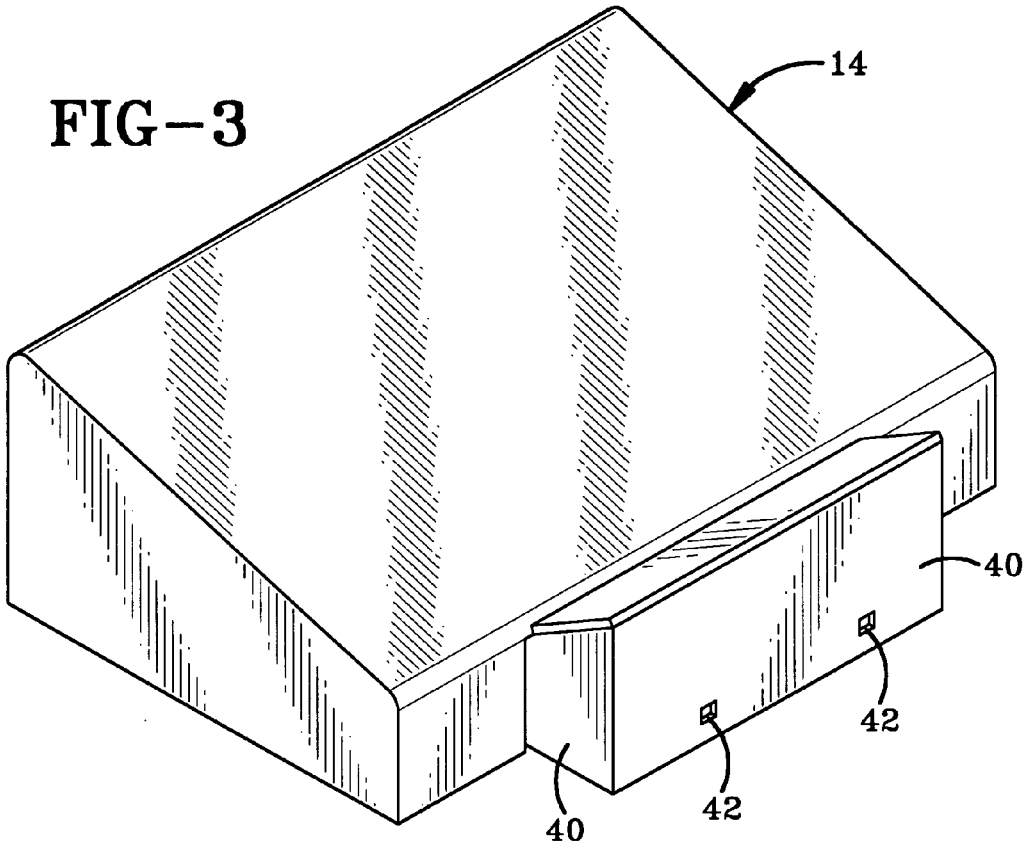
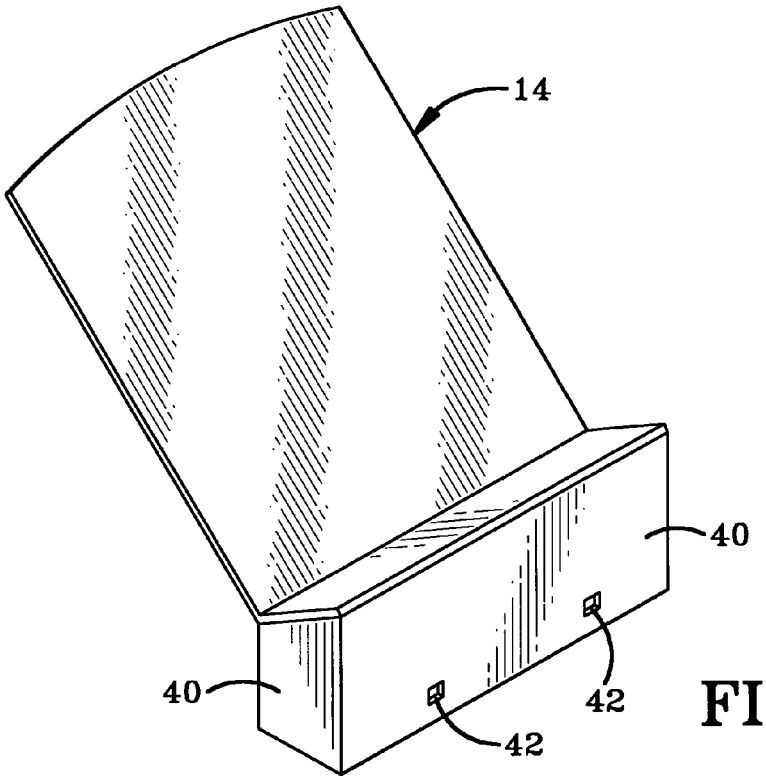
FIG-4

ALARMING MERCHANDISE DISPLAY SYSTEM

CROSS REFERENCE TO RELATED APPLICATION

This application claims the benefit of and priority from U.S. Provisional Patent Application Ser. No. 60/503,102 filed Sep. 12, 2003 and U.S. Provisional Patent Application Ser. No. 60/592,899 filed Jul. 30, 2004; the disclosures of which are incorporated herein by reference.

BACKGROUND OF THE INVENTION

1. Technical Field

The present invention generally relates to merchandise display systems and, more particularly, merchandise display systems with anti-theft security features. Specifically, the merchandise display system of the present invention allows a customer to directly handle an item of merchandise while preventing a shoplifter from removing the item of merchandise from the display without triggering an alarm.

2. Background Information

Small electronic devices are a preferred target for shoplifters because the devices are relatively expensive and easy to conceal. These small electronic devices include digital cameras, portable digital assistants (PDAs), hand-held computers, laptop computers, and portable phones. The owners of retail establishments continue to seek apparatus and methods for protecting these devices from shoplifters while not interfering with the ability of a legitimate customer to handle and test the merchandise. Merchants have found that locking such small electronic devices in a glass cabinet decreases sales because customers feel less comfortable asking for the cabinet to be unlocked and then handling and testing the items under the scrutiny of a store employee. Merchants thus desire a merchandise display system that allows legitimate consumers to freely handle and test items of merchandise while preventing a shoplifter from removing the items of merchandise from the display area.

Various systems for securing items of merchandise at a display area are known in the art. One system simply tags each item of merchandise with an electronic article surveillance (EAS) tag that triggers an alarm if the item of merchandise is passed through an antenna or sensor that is typically positioned at the exits to the retail establishment. This system has two drawbacks when used with small electronic items. The first drawback is that some shoplifters will simply grab a handful of expensive items and quickly leave the store triggering the alarm while making a fast getaway. The payoff from the relatively expensive electronic items is worth the risk of triggering the alarm. Another problem is that the shoplifter can typically remove the EAS tag from the electronic item because it is difficult to secure an EAS tag to a small electronic item. The EAS tags usually cannot be placed inside the electronic item and merchants do not wish to use a permanent adhesive that will damage the display item.

Other security display systems known in the art use cables to secure the items of merchandise to the display unit. The cables prevent the item from leaving the display area while providing enough movement for a legitimate consumer to handle and test the item of merchandise. Some of these cable-based systems use alarms that are triggered if a shoplifter cuts the cable, removes the cable from the display unit, or removes the cable from the item of merchandise.

BRIEF SUMMARY OF THE INVENTION

The present invention provides an alarming display system having interchangeable components that allows the display system to be reconfigured to be used with different items of merchandise.

In one embodiment, the invention provides an alarming merchandise display system having interchangeable components wherein at least one of the components is locked in place in a manner that triggers an alarm if the component is removed from the system without first unlocking a lock.

In one embodiment, the invention provides an alarming merchandise display system having an alarm switch that is adapted to disarm the alarm system when one of the locks is unlocked with its key.

In another embodiment, the invention provides an alarming merchandise display system having an alarm unit that is in communication with a switch that is used to connect a cable to the item of merchandise, the cable that connects the switch to the alarm unit, and an alarm switch that monitors the status of the components of the system such that the alarm will be triggered upon tampering with any of the alarmed components.

In a further embodiment, the invention provides an alarming merchandise display system having an alarm unit that is secured to a base with a first magnetically-actuated lock and a second mechanically-actuated lock in a manner that requires both locks to be moved from their locked position to the unlocked position before the alarm unit may be removed from the base.

The invention also provides an embodiment wherein the shelf that supports the item of merchandise for display is secured against theft by the cable that retains the item of merchandise to the alarm unit.

The invention also provides an alarming display unit that is self-contained without the need for a connection with an external alarm system.

BRIEF DESCRIPTION OF THE SEVERAL VIEWS OF THE DRAWINGS

FIG. 3 is a perspective view of an alternative display shelf used with the alarming display system of the present invention.

FIG. 4 is an alternative display shelf used with the alarming display system of the present invention.

Similar numbers refer to similar parts throughout the specification.

DETAILED DESCRIPTION OF THE INVENTION

Figure 1:
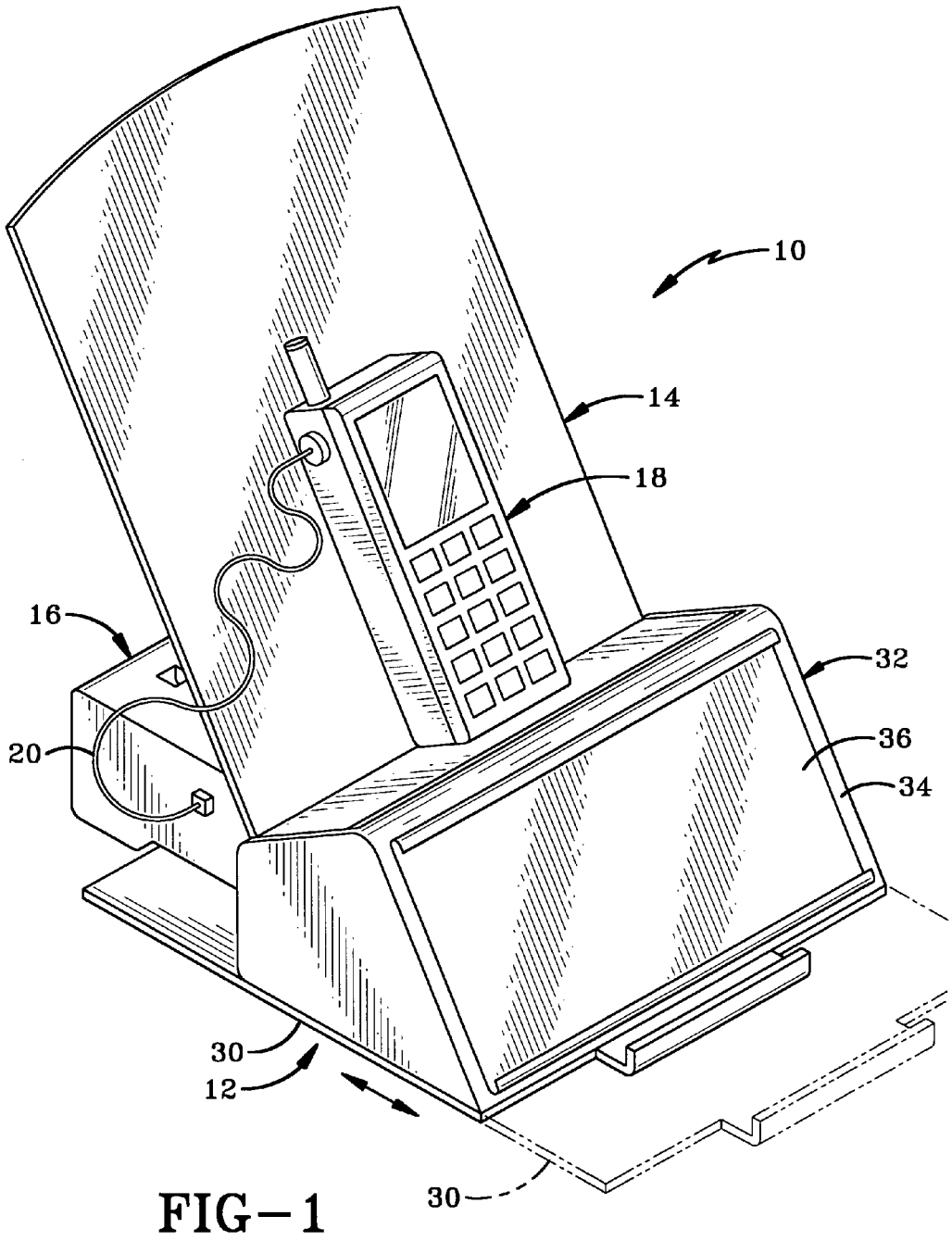
FIG. 1 is a perspective view of a first embodiment of the alarming display system made in accordance with the concepts of the present invention.

The first embodiment of the alarming display system of the present invention is indicated generally by the numeral 10 in FIGS. 1–5. Display system 10 generally includes a base 12, a display shelf 14, and an alarm unit 16. Base 12, shelf 14, and alarm unit 16 cooperate together to provide a display area for an item of merchandise 18 in a retail environment. Merchandise 18 is connected to alarm unit 16 with a cable 20. Cable 20 is designed to trigger an alarm carried by alarm unit 16 if the cable is cut, removed from merchandise 18, or removed from alarm unit 16. Alarm unit 16 is configured to sound an alarm if alarm unit 16 is removed from base 12. Shelf 14 is locked to base 12 by a portion of alarm unit 16. The components of display system 10 thus cooperate together to provide an alarming display unit that conveniently displays merchandise 18 in a manner that prevents a shoplifter from removing merchandise 18 or any component of system 10 from the display area without triggering the alarm disposed within alarm unit 16.

Display system 10 is also configured to accept different size shelves 14 such as those shown in FIGS. 3 and 4. Any of a variety of other shelf sizes or types may be used depending on the type of merchandise 18 being displayed with system 10.

Display system 10 is installed on a support surface such as support structure 22 provided at the retail establishment selling merchandise 18. Support structure 22 defines at least one opening 24 sized to slidingly receive a connector 26 that mounts base 12 to support structure 22. Connector 26 may be a nut and bolt combination as shown in the drawings. Alternatively, connector 26 may be any of a variety of other connectors that are known in the art. Still alternatively, opening 24 may be threaded to receive a threaded connector 26 such as a machine bolt or screw. When connector 26 is in the form of a bolt and nut as shown in the drawings, the underside 28 of support structure 22 should not be accessible by the consumer so that a shoplifter cannot simply remove the nut of connector 26 and steal all of the components of system 10 along with merchandise 18.

Figure 2:
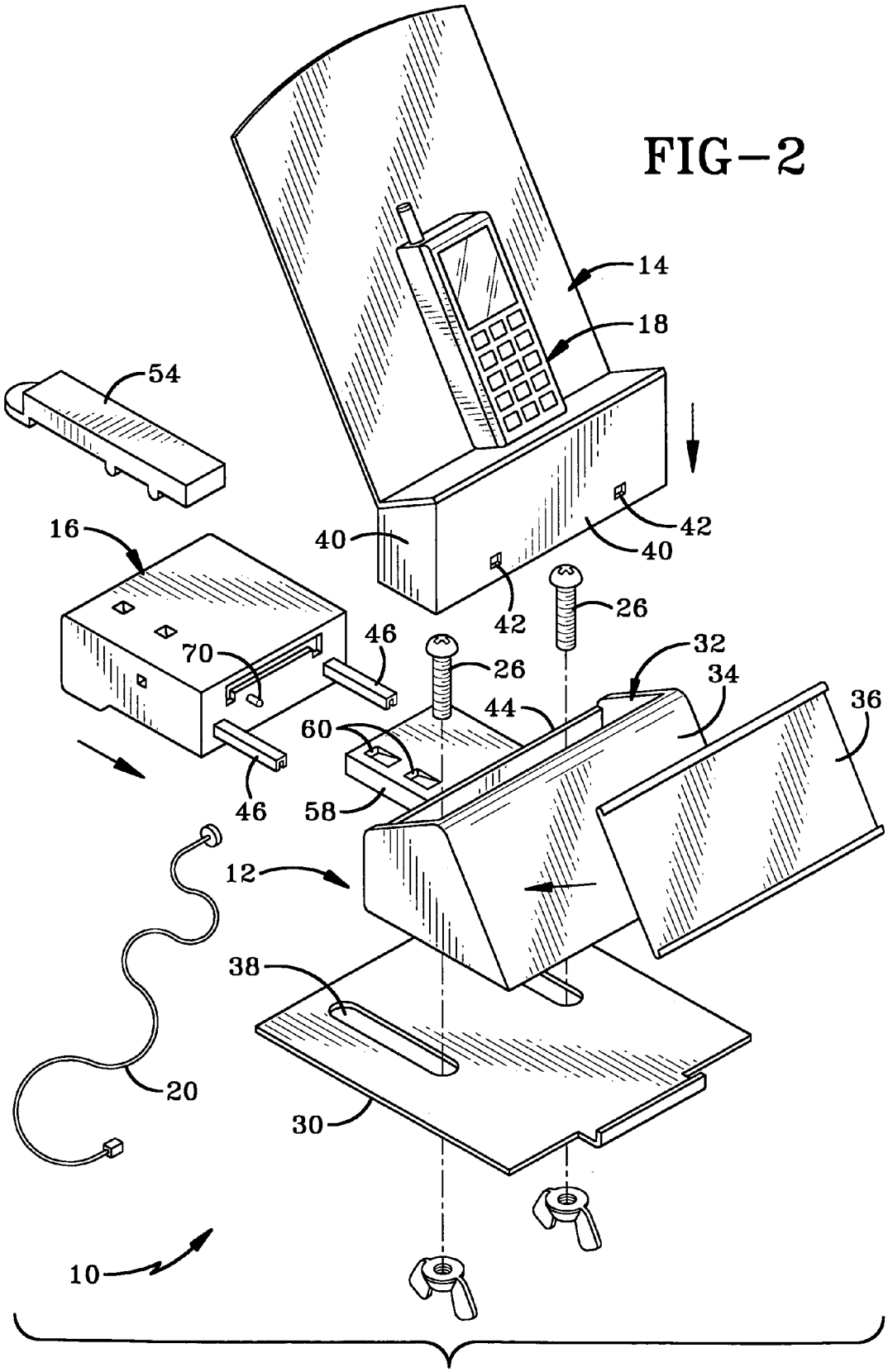
FIG. 2 is an exploded view of the alarming display system of FIG. 1.

In the embodiment of the invention shown in the drawings, base 12 includes a base tray 30 and a locking socket 32. Locking socket 32 may optionally include a display wall 34 that may optionally carry a card holder 36 used to receive information about merchandise 18 such as a product-name, product number, and/or price. Base 12 may be designed to be used with a single connector 26 or a pair of connectors 26 as depicted in FIG. 2. When a pair of connectors 26 are used, base tray 30 defines a pair of slots 38 that correspond to the connectors 26. The use of base tray 30 is optional and locking socket 32 may be locked directly to support structure 22 if desired. Base tray 30 provides a stable mounting surface when support structure 22 is a wire frame shelf. Tray 30 may also be configured to pull out from under socket 32 to an extended position. The extended position of tray 30 allows a graphic to be placed on tray 30 that includes detailed information about product 18. The extent of the extended position of tray 30 is defined by the length of slots 38.

Figure 5:
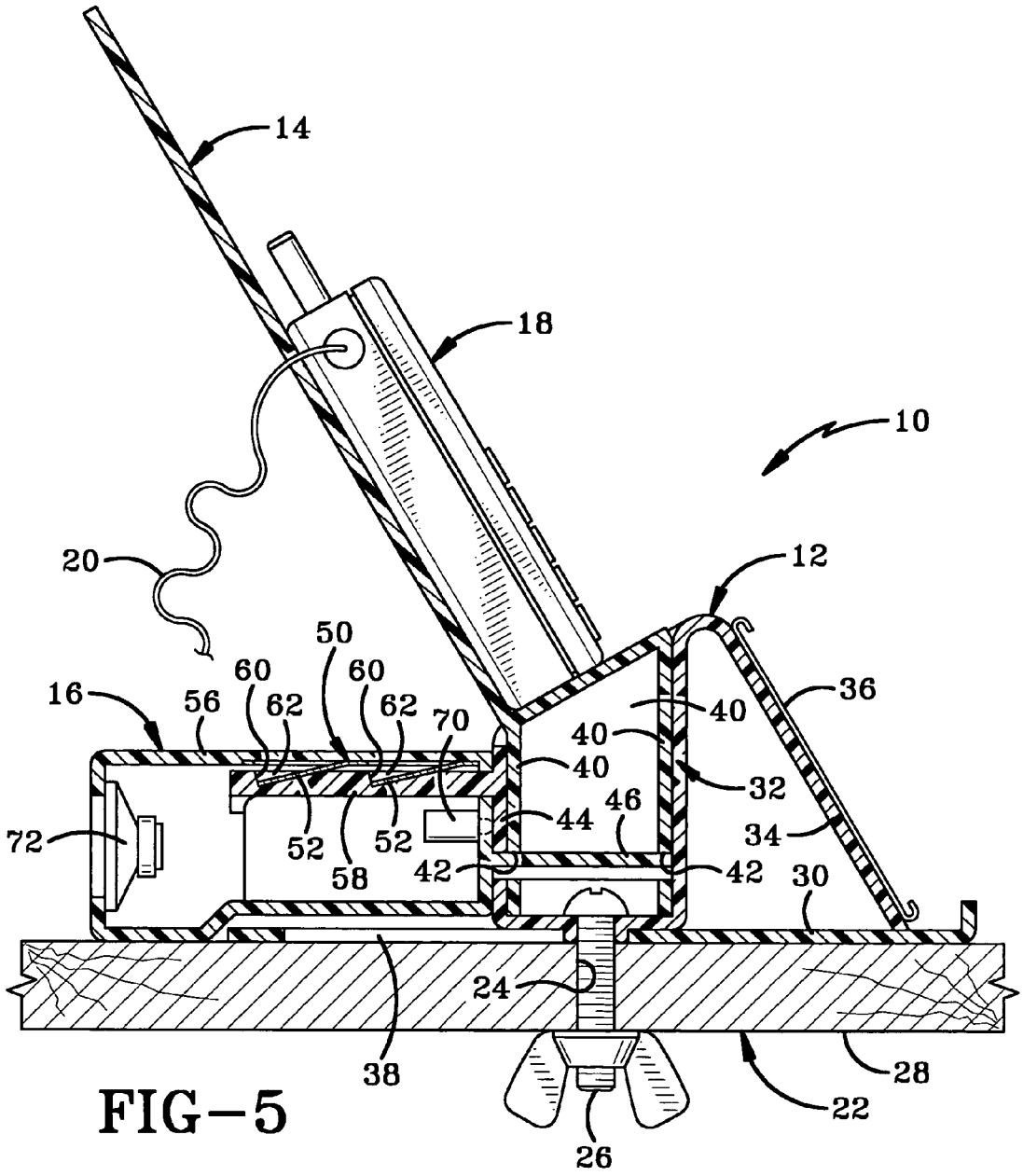
FIG. 5 is a section view of the alarming display system of the present invention.

Locking socket 32 is designed to slidingly receive the legs 40 of shelf 14 to securely hold shelf 14 in an upright position. Legs 40 of shelf 14 and locking socket 32 each define at least one lock opening that are aligned when shelf 14 is seated in locking socket 32. The number and position of lock openings 42 may vary depending on the particular design of system 10. In the embodiment of system 10 depicted in the drawings, openings 42 are disposed in leg 40 and the rear wall 44 of locking socket 32 disposed closest to alarm unit 16. Alarm unit 16 includes a locking arm 46 that is disposed through lock openings 42 of locking socket 32 and shelf 14 to securely lock shelf 14 to base 12 when alarm unit 16 is in the locked position. The locked position is depicted in FIGS. 1 and 5. In one embodiment of the invention, locking arm 46 may be disposed directly above connector 26 to prevent access to connector 26. In this configuration, a shoplifter cannot push connector 26 up into base 12 or shelf 14 because locking arm 46 blocks the path of connector 26 when alarm unit 16 is in the locked position.

Alarm unit 16 is locked in the locked position by an appropriate lock 50. In the embodiment of the invention depicted in the drawings, lock 50 includes a pair of biased locking fingers 52 that are magnetically attractable so that they may be moved from the locked position of FIG. 5 to an unlocked position (not shown) by an appropriate magnet. The magnet is disposed in a key 54. Lock 50 is carried by the upper wall 56 of alarm unit 16 and lockingly engages a locking leg 58 that projects from base 12. Leg 58 defines a pair of ledges 60 against which locking fingers 52 engage in the locked position. Leg 58 may also define sidewalls 62 that are disposed on either side of locking fingers 52 to trap locking fingers 52 in the locked position. The configuration of leg 58 and arm 46 allows alarm unit 16 to be automatically locked in its locked position when alarm unit 16 is slid into base 12 to lock shelf 14 in place.

Alarm unit 16 includes a plunger 70 that engages the base 12 when alarm unit 16 is in the locked position. Plunger 70 is configured to move to an activated position when alarm unit 16 is moved away from base 12. Alarm unit 16 is configured to sense the activated position of plunger 70 and activate an alarm if alarm unit 16 is improperly removed from base 12. The alarm in alarm unit 16 may be an audible alarm presented through speaker 72 or a silent alarm triggered through appropriate mechanisms. Alarm unit 16 may be configured to deactivate when key 54 is properly used to unlock alarm unit 16 from base 12. In other embodiments, a separate key or code must be used to deactivate alarm unit 16 before key 54 is used to detach alarm unit 16 from base 12.

The second embodiment of the alarming display system of the present invention is indicated generally by the numeral 100 in FIGS. 6–32. Display system 100 generally includes a base 112, a display shelf 114, and an alarm unit 116. System 100 provides a secure display area for an item of merchandise 118 in any of a variety of environments. The secure display area allows item 118 to be lifted and handled while preventing item 118 from being removed from the display area without triggering an alarm.

Alarming display system 100 is also self-contained in that it does not need to be connected to external alarm systems to provide its alarming capabilities. The self-contained nature of system 100 allows it to be flexibly used (in different manners, different locations, and different configurations). As described above, display system 100 is also configured to accept different sized shelves 114 such as those shown in FIGS. 3 and 4. Any of a variety of other shelf sizes, shapes, or types may be used with system 100. In this embodiment, shelves 114 are simply frictionally fit, snap fit, and latched to alarm unit 116 or base 112 so that they may be readily changed after system 100 is disarmed.

Alarm unit 116 (FIGS. 9 and 12–14) includes a compartment having a base 119, sidewalls 123 and a top closure member 111 secured to base 119 by a plurality of fasteners 115 which are located within and extend through hollow posts 117. Posts 117 preferably are formed integrally with and extend upwardly from base 119. Top closure member 111 is formed with an opening 127 through which an alarm cable 120 extends for connection to item 118.

Item 118 is connected to alarm unit 116 with an alarm cable 120. Alarm cable 120 is designed to trigger an alarm carried by alarm unit 116 if cable 120 is cut, removed from item 118, or removed from alarm unit 116. Alarm unit 116 is configured to trigger an alarm if alarm unit 116 is removed from base 112 without the proper use of a key to unlock alarm unit 116 from base 112. Shelf 114 is secured against theft because alarm cable 120 passes through an opening 121 defined by shelf 114. Opening 121 is smaller than most items of merchandise 118. Shelf 114 is thus trapped between item 118 and alarm unit 116 when item 118 is displayed by system 100. The components of alarming display system 100 thus cooperate together to provide an alarming display system that conveniently displays items of merchandise 118 in a manner that prevents shoplifters from removing items 118 or components of system 100 from the display area without triggering an alarm carried within alarm unit 116.

Figure 11:
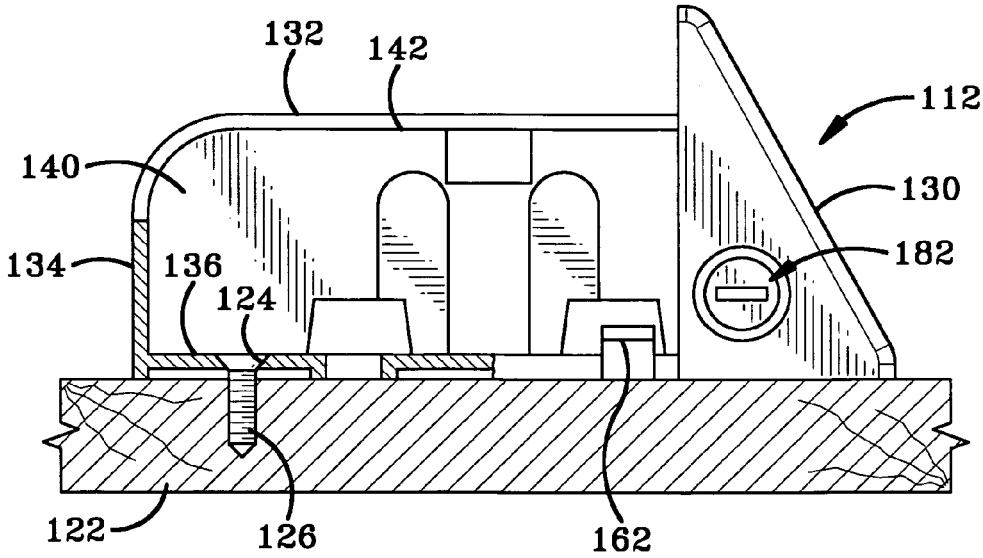
FIG. 11 is a section view taken along line 11—11 of FIG. 10.
Figure 12:
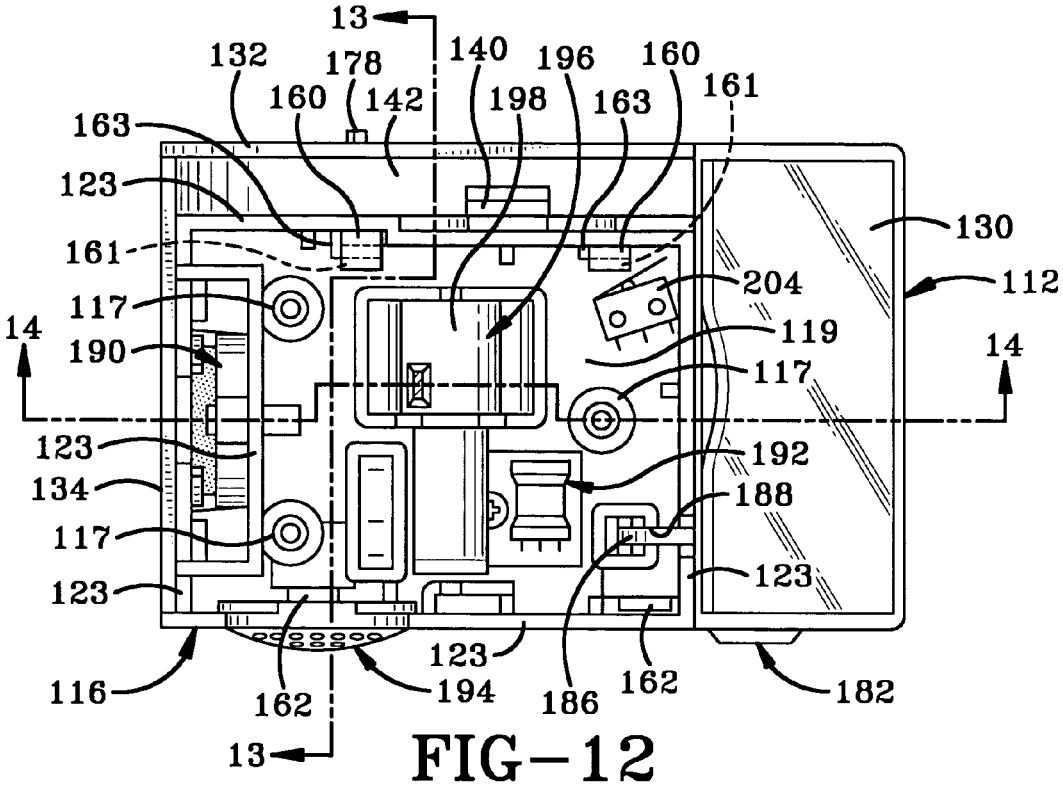
FIG. 12 is a top plan view of the alarm unit and base with the first portion of the housing removed.

Display system 100 is installed on a support surface 122 such as a counter, a shelf, a wall, or a fixture provided at the display area for item 118. System 100 may be configured to work with essentially any type of support structures by altering the design of base 112 and/or the connectors used to secure base 112. Base 112 is secured to support surface 122 with any of a variety of connectors that securely hold base 112 in place to prevent a shoplifter from simply lifting base 112 away from support surface 122. In the exemplary embodiment, the connectors pass through openings 124 defined by base 112. Openings 124 are covered by alarm unit 116 when alarm unit 116 is locked to base 112 to prevent a shoplifter from tampering with the connectors. A threaded connector 126 is shown in FIG. 11 as an example with four connectors 126 shown in FIG. 10. Various other connectors 126 may be used to secure base 112 to support structure 122. Such connectors 126 include nut and bolt combinations, adhesives, welds, interlocking fits, snap fits, and the like. Essentially, any type of connector may be used to secure base 112 in a position where base 112 cannot be removed from the display area by a shoplifter.

In the exemplary embodiment of the invention shown in the drawings, base 112 includes a front wall 130, a side wall 132, and a rear wall 134 that each extend upwardly from a bottom wall 136. These walls cooperate together to define an alarm unit recess sized to receive at least a portion of alarm unit 116. Front wall 130 optionally includes a display area where the merchant may place textural or graphic information identifying item 118 and/or its price. In the exemplary embodiment, side wall 132 defines the outside of a first lock cavity 138. An inner lock wall 140 defines the inner surface of first lock cavity 138 with a top lock wall 142 defining the top of first lock cavity 138. Cavity 138 provides a secure location for a first lock 144 that is used to selectively lock alarm unit 116 to base 112 such that alarm unit 116 is selectively lockable to base 112 and selectively removable from base 112.

First lock 144 is movable between a locked position (FIGS. 15–16) to an unlocked position (FIGS. 22–23) when unlocked with a specially designed key. The term "locked" in this application refers to a relationship between elements that requires a key to undo. The term "locked" is thus distinguishable from the term "latch." A "latched" relationship between two elements does not require a key to undo and thus may be undone by anyone at any time.

Figure 16:
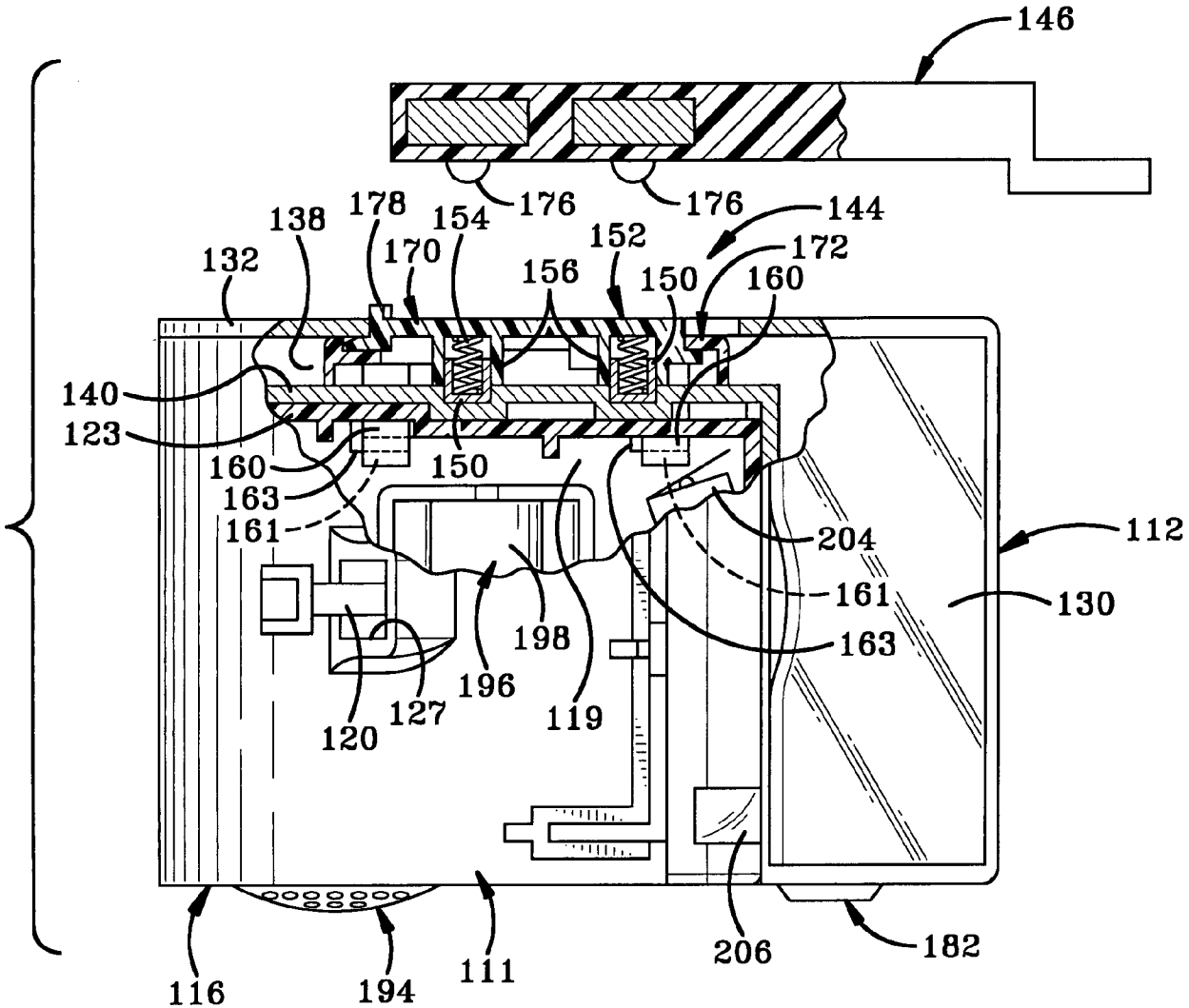
FIG. 16 is a top view, partially in section, showing the locked position of the first lock and that the first lock is disengaged from the alarm switch.
Figure 17:
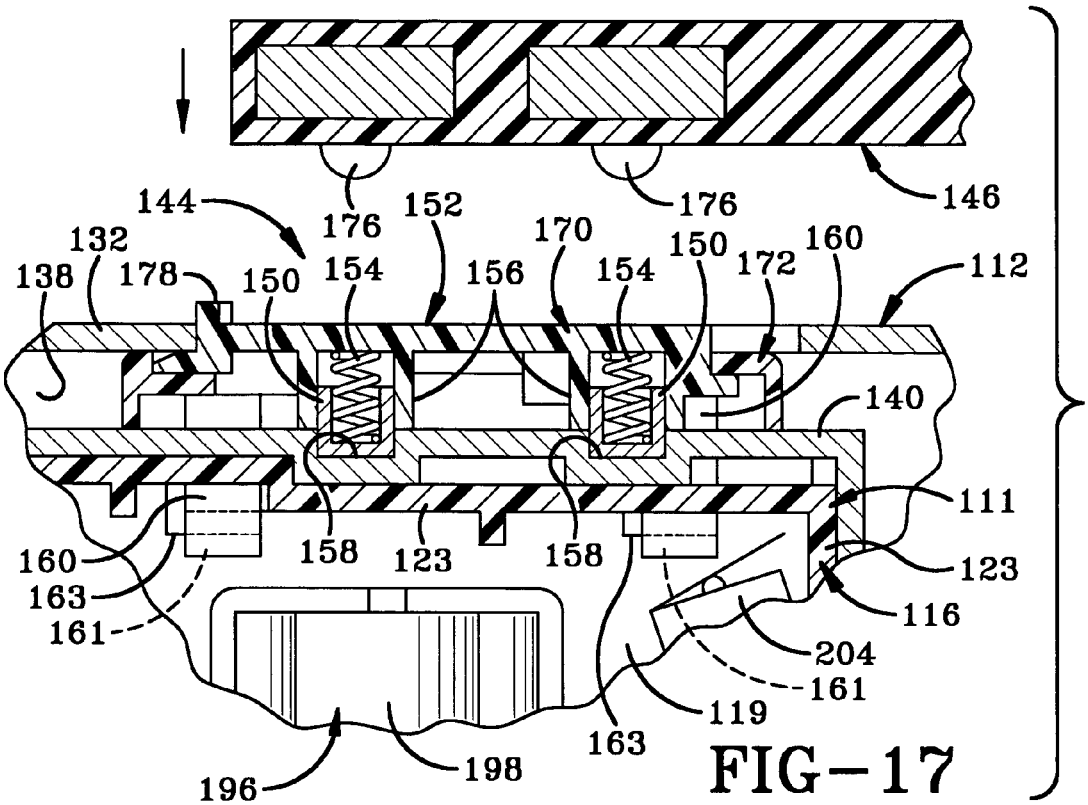
FIG. 17 is an enlarged view of a portion of FIG. 16 showing the first key being moved toward the first lock.

First lock 144 and first key 146 may operate in a variety of known manners. The exemplary embodiment uses magnetically-attractable lock fingers 150. Lock fingers 150 lock the position of a moveable lock element 152 with respect to inner lock wall 140 when first lock 144 is in the locked position as shown in FIGS. 16 and 17. First lock 144 includes a pair of lock fingers 150 in this embodiment of the invention. A single lock finger 150 or more than two lock fingers 150 may also be used in alternative embodiments. Each lock finger 150 is biased toward the locked position of FIGS. 13, 16, and 17 by appropriate biasing elements 154. Biasing elements 154 may be the coil springs shown in the drawings. In other embodiments, biasing elements 154 may be integrally formed with lock finger 150 by bending a thin piece of spring steel to form lock finger 150. Biasing elements 154 may also be an elastic material. Biasing element 154 may be formed integrally with or separate from lock finger 150.

Figure 13:
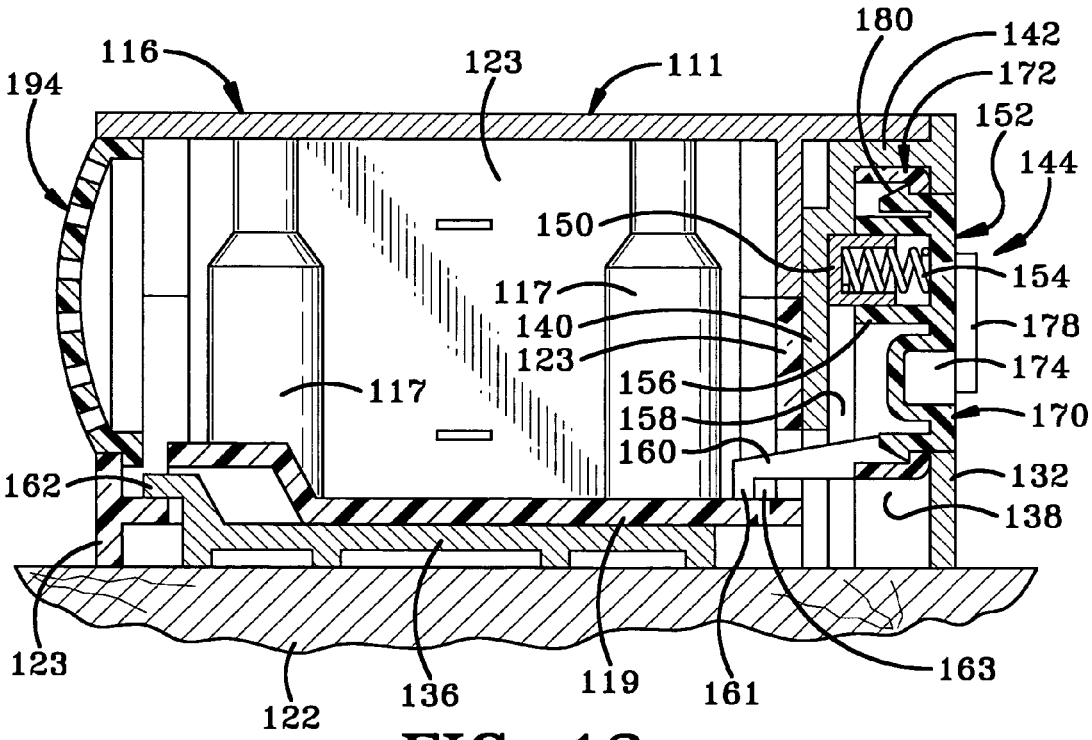
FIG. 13 is a section view taken along line 13—13 of FIG. 12.

In the exemplary embodiment, each biasing element 154 and lock finger 150 is slidingly disposed in a sleeve 156 projecting inwardly from moveable lock element 152. Sleeve 156 allows lock finger 150 to freely move with respect to moveable lock element 152 (between its locked and unlocked positions) and maintains the position of moveable lock element 152 with respect to inner lock wall 140 by abutting the outwardly facing surface of inner lock wall 140 as shown in FIGS. 13,16, and 17. The outwardly facing surface of inner lock wall 140 defines a lock finger recess 158 for each lock finger 150. Lock finger 150 is biased into recess 158 when moveable lock element 152 is in the locked position.

Figure 19:
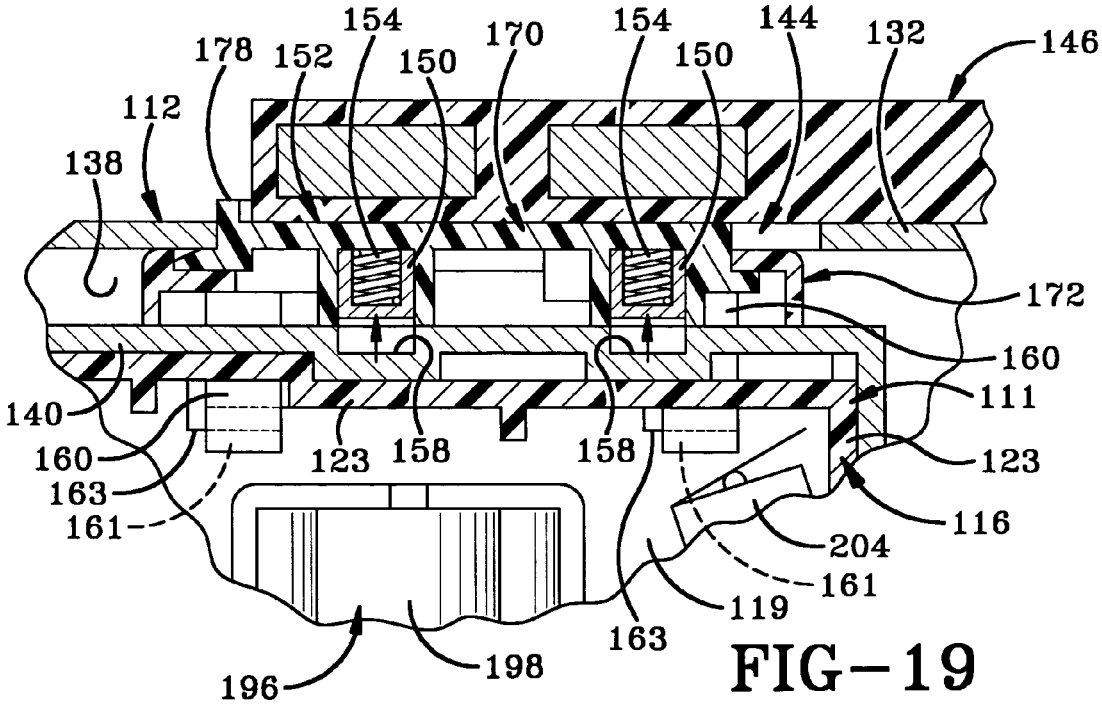
FIG. 19 is a section view similar to FIG. 17 showing the first key engaged with the first lock and moving the lock fingers to the unlocked position.
Figure 18:
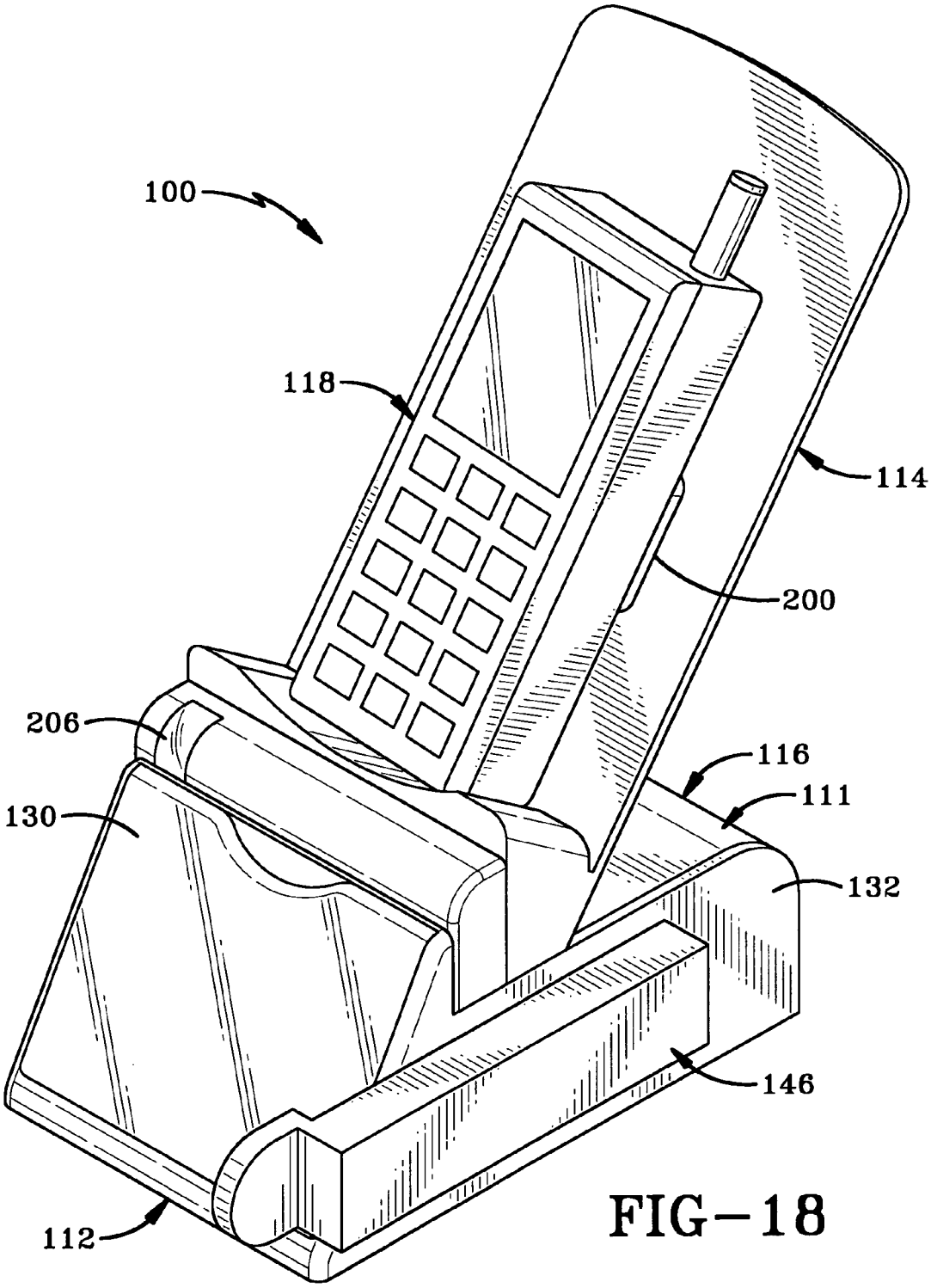
FIG. 18 is a perspective view showing the first key engaged with the first lock.
Figure 20:
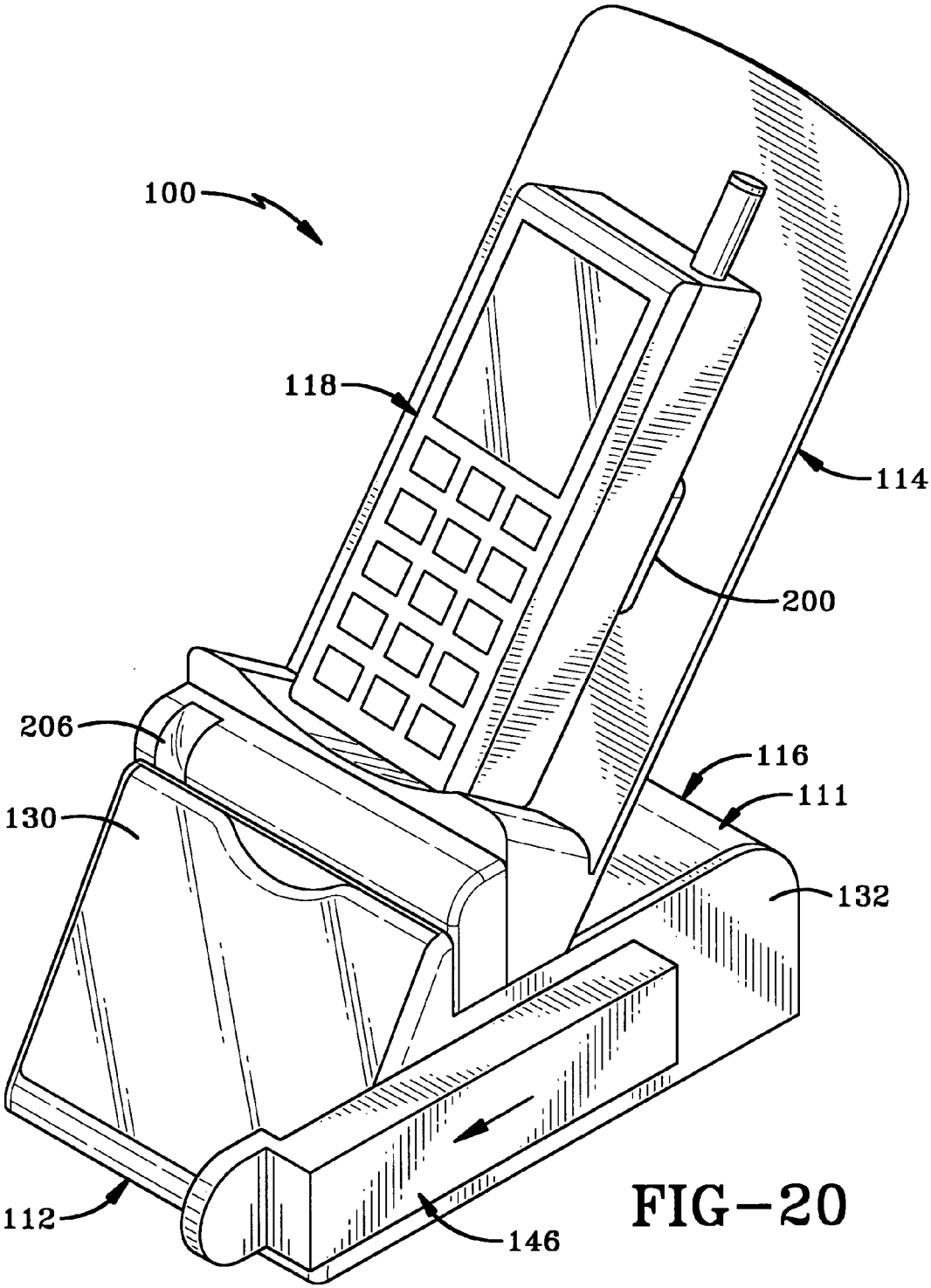
FIG. 20 is a perspective view similar to FIG. 18 showing the key moved to the unlocked position.
Figure 21:
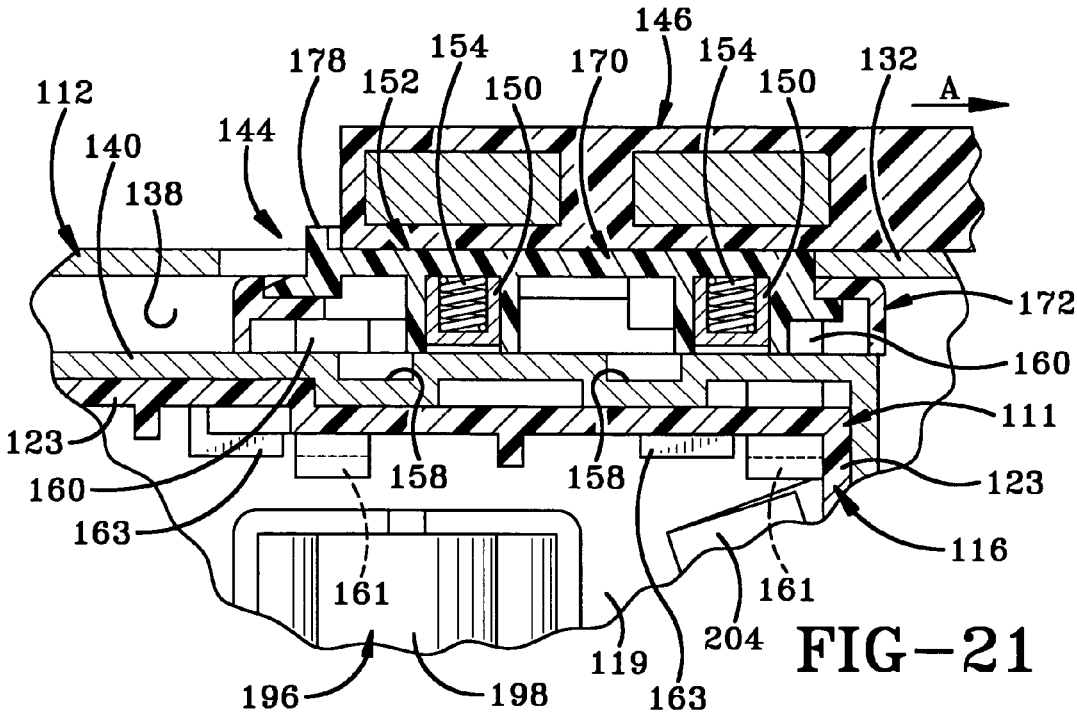
FIG. 21 is a view similar to FIG. 17 showing the first key and first lock moved to the unlocked position with the alarm switch tripped.
Figure 23:
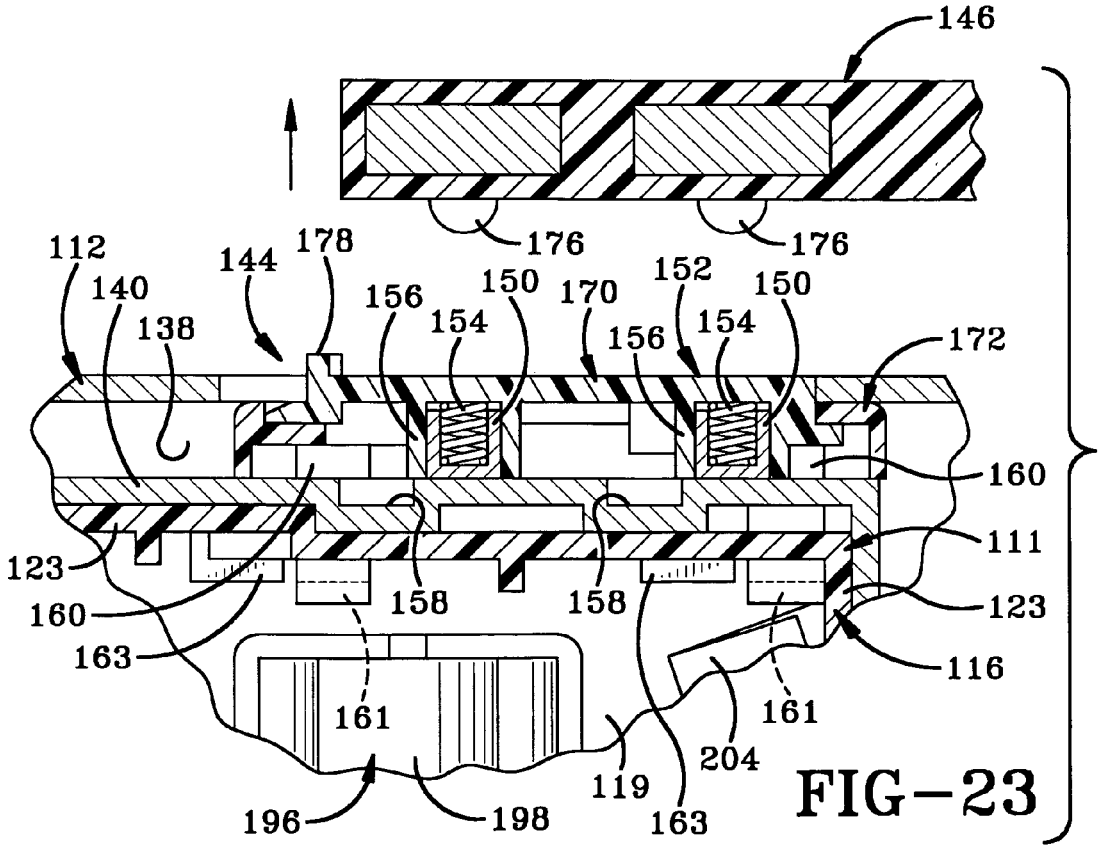
FIG. 23 is a view similar to FIG. 21 showing the first key removed from the first lock.
Figure 22:
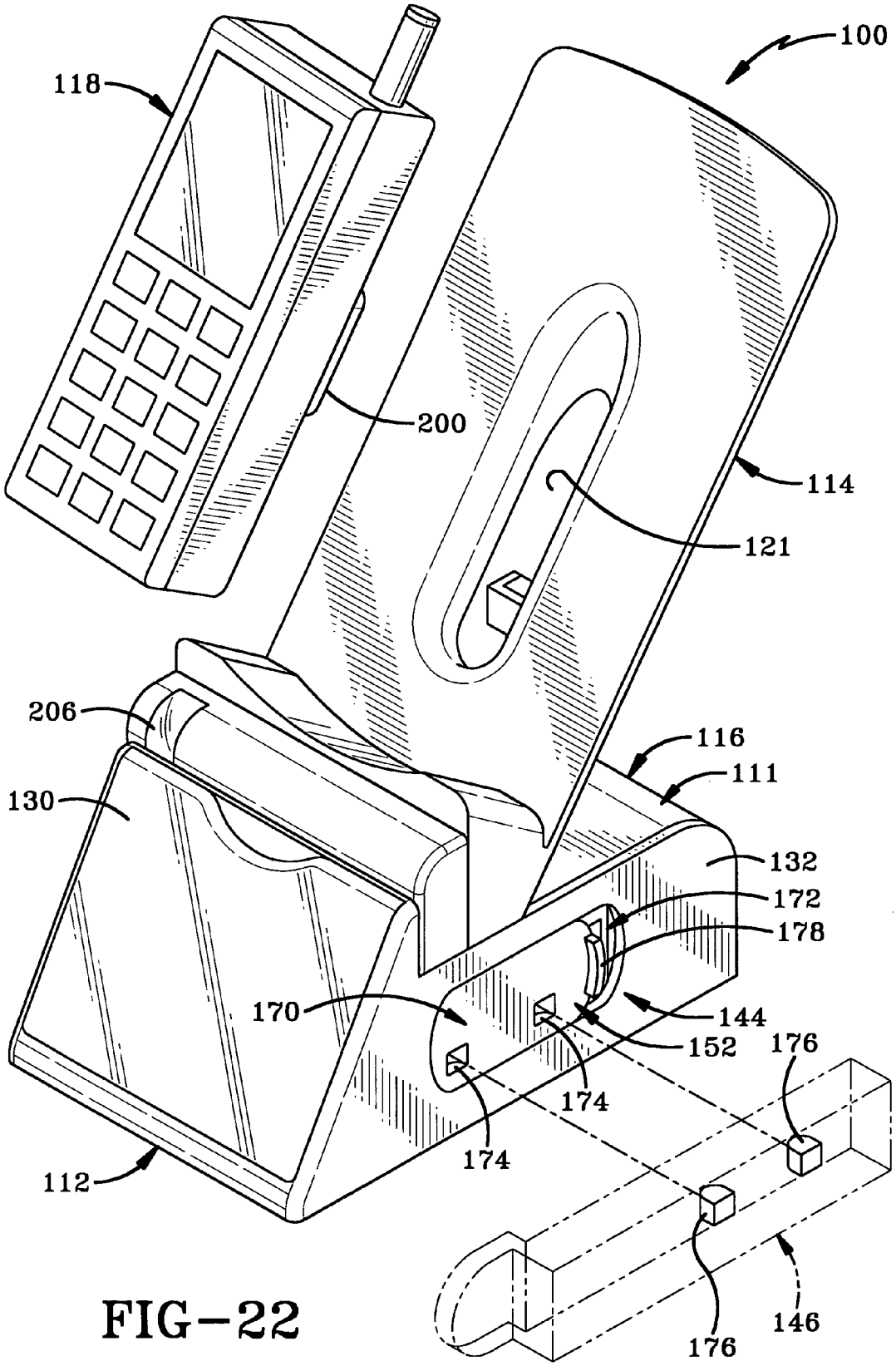
FIG. 22 shows the removal of the first key from the first lock and the item of merchandise being removed from the cable.
Figure 24:
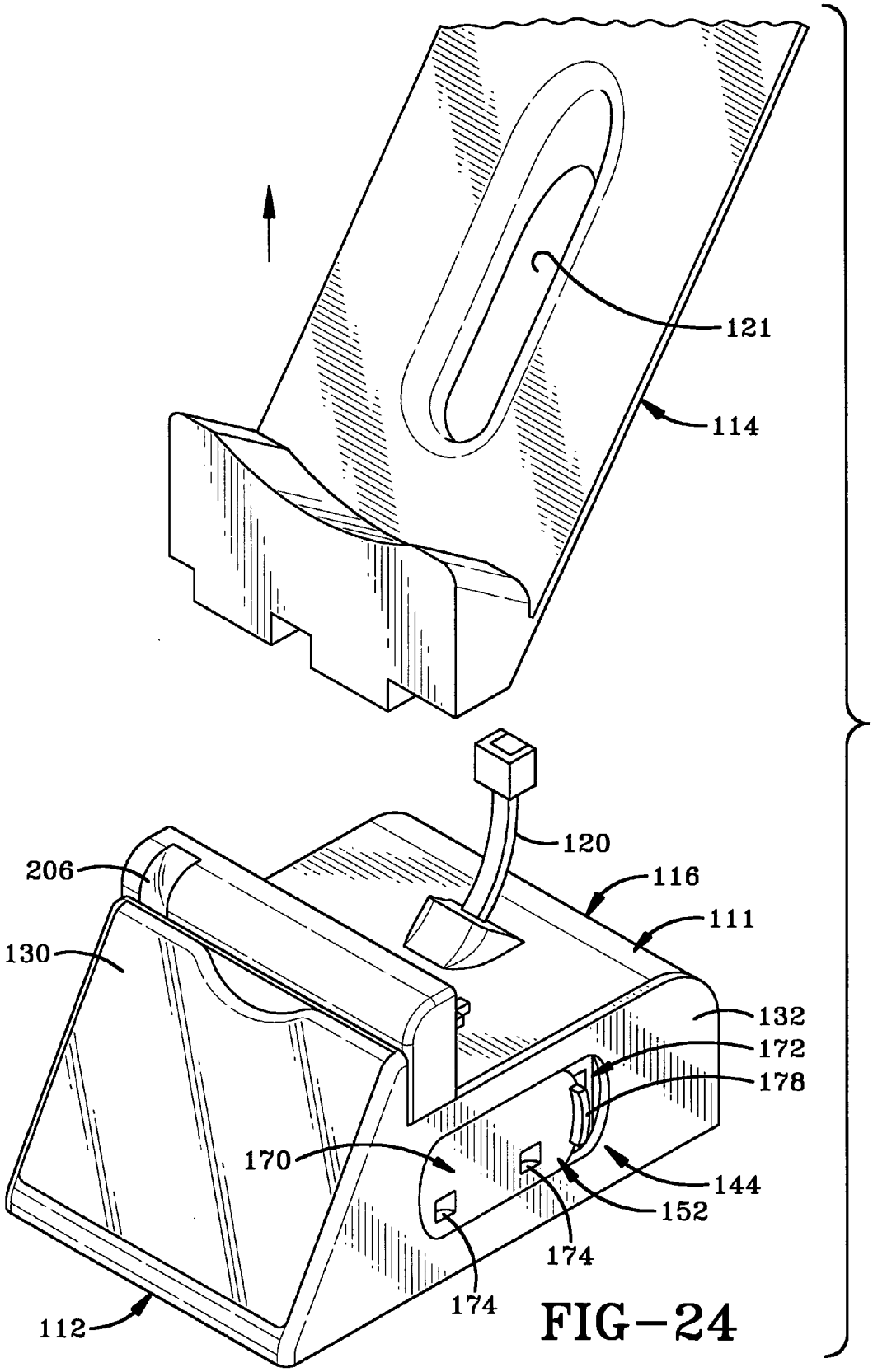
FIG. 24 is a perspective view showing the first lock in the unlocked position and the shelf being removed from the alarm unit.
Figure 25:
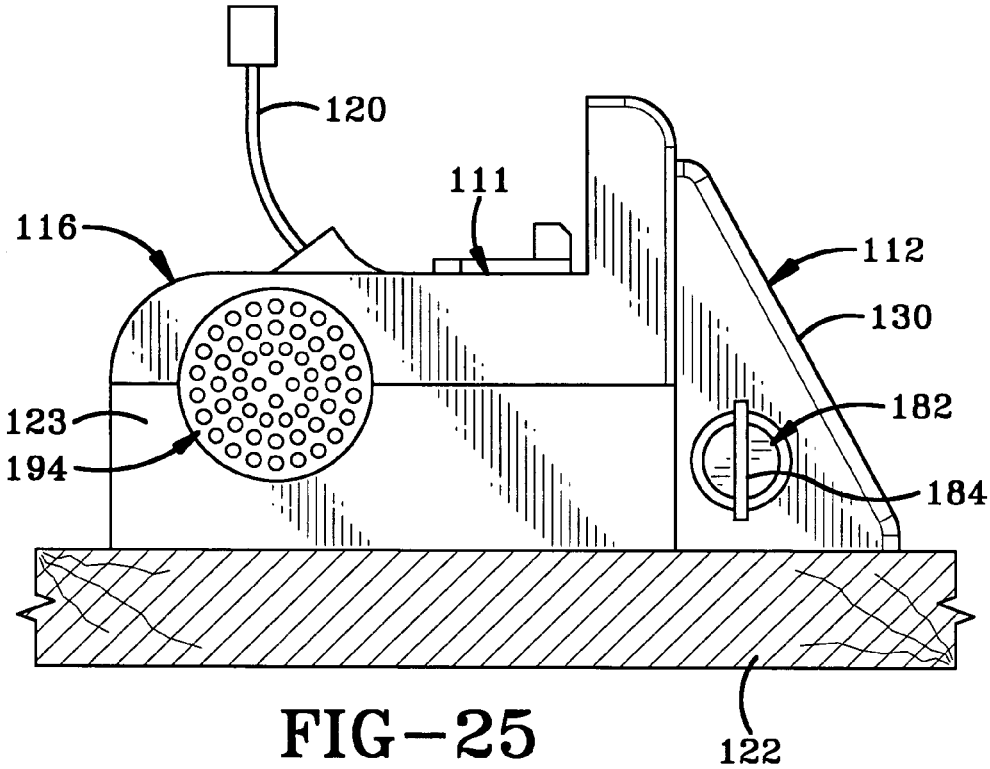
FIG. 25 is a left side elevation view of the base and the alarm unit with the shelf removed and the second lock in the locked position.
Figure 27:
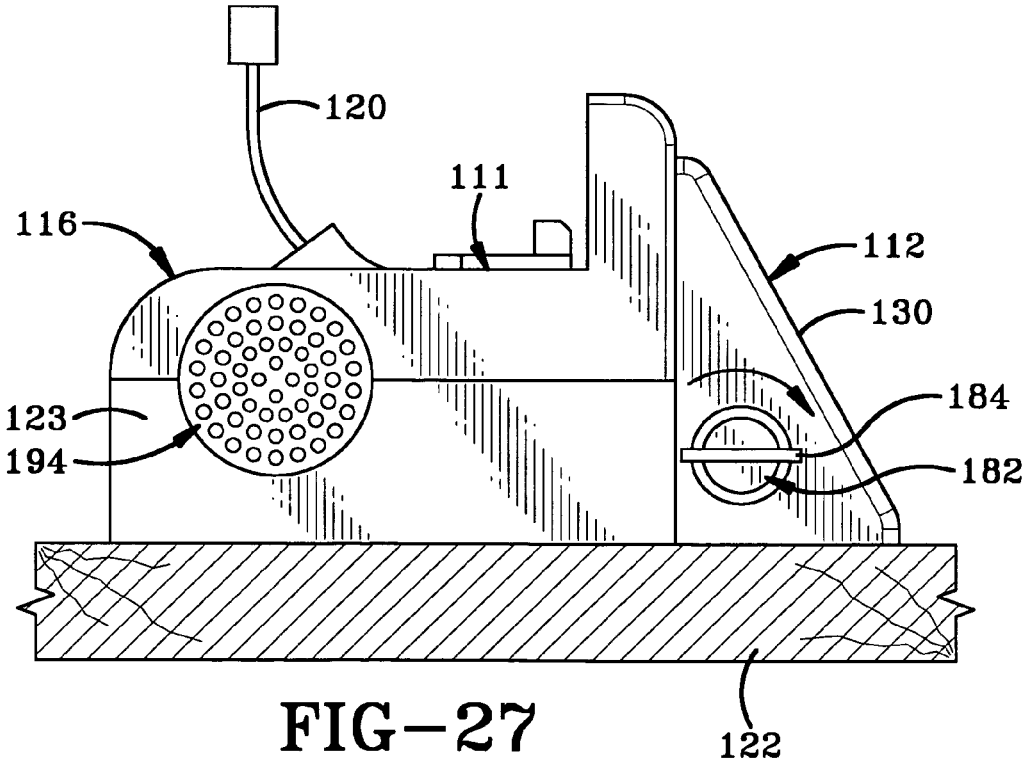
FIG. 27 is a view similar to FIG. 25 showing the second lock in the unlocked position.
Figure 26:
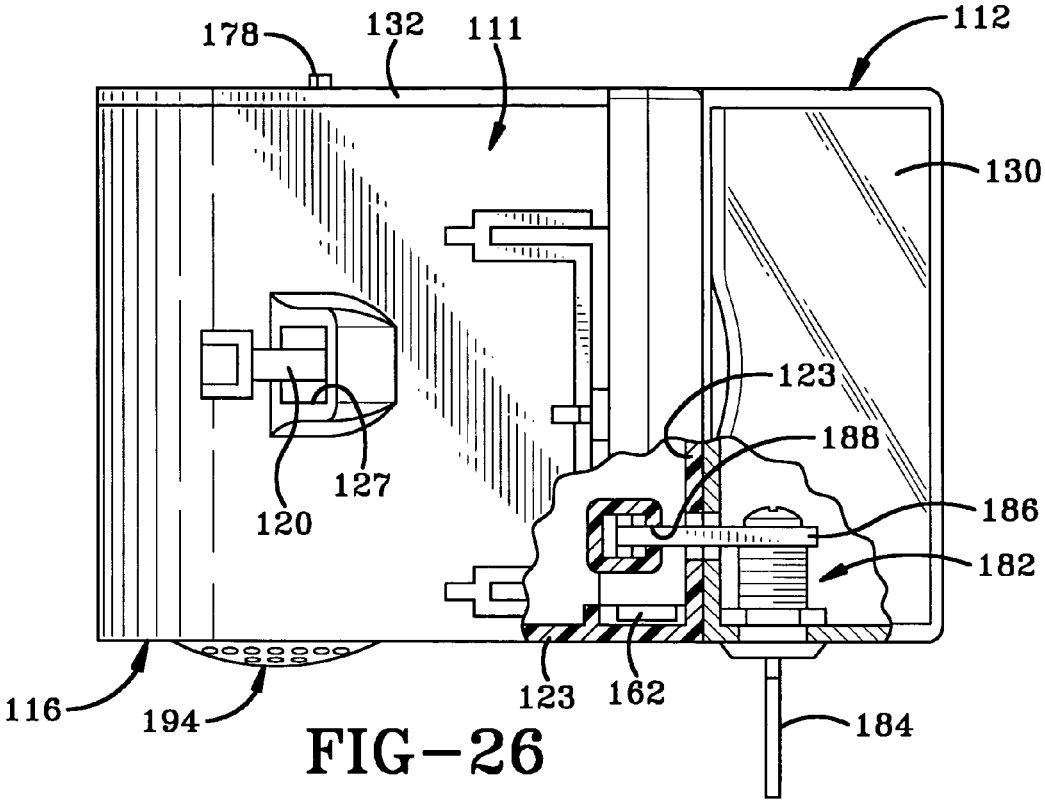
FIG. 26 is a top plan view of FIG. 25 with a portion broken away showing the lock finger of the second lock engaging the alarm unit.
Figure 30:
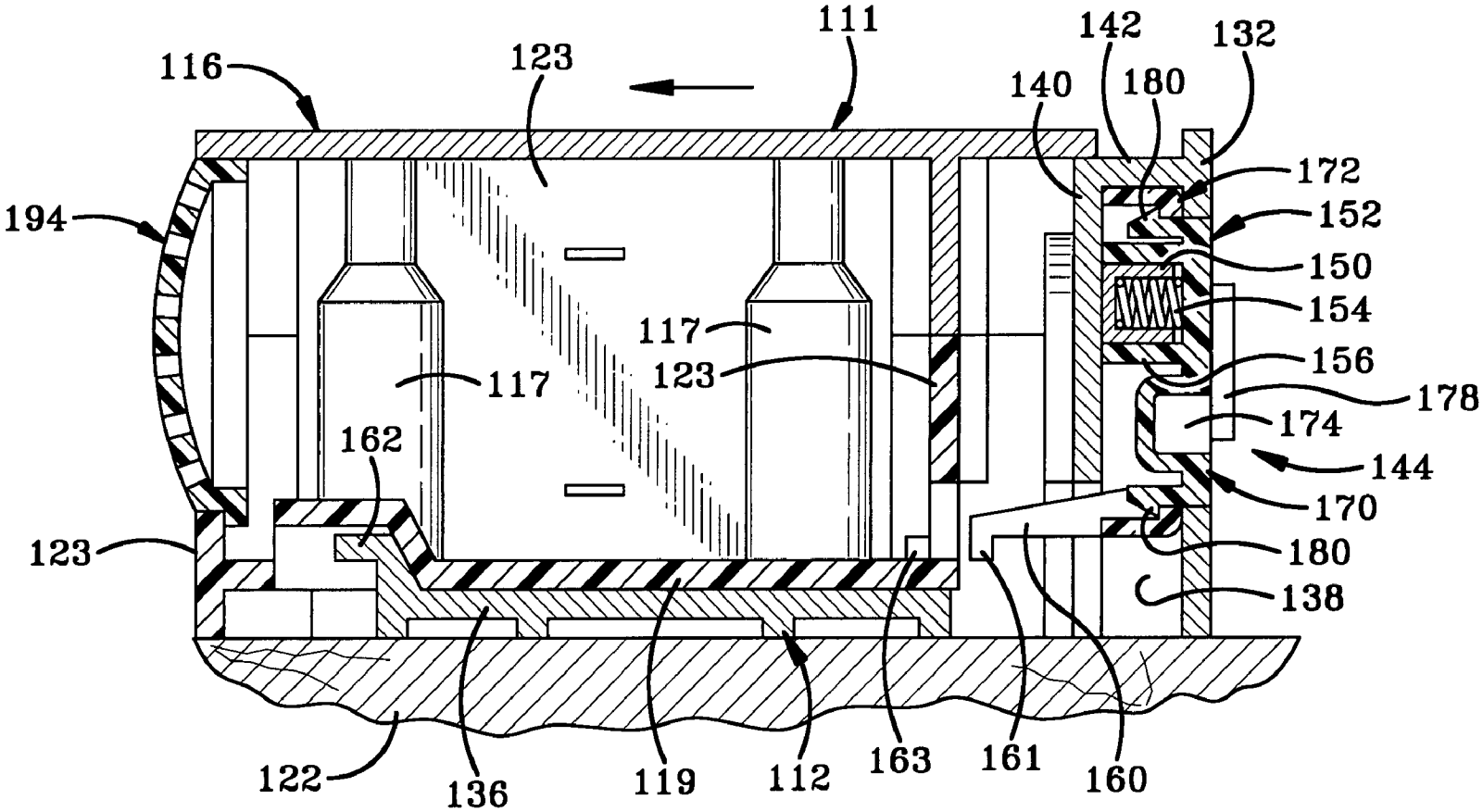
FIG. 30 is a section view taken through the alarm unit and base showing the alarm unit being removed from the base.
Figure 31:
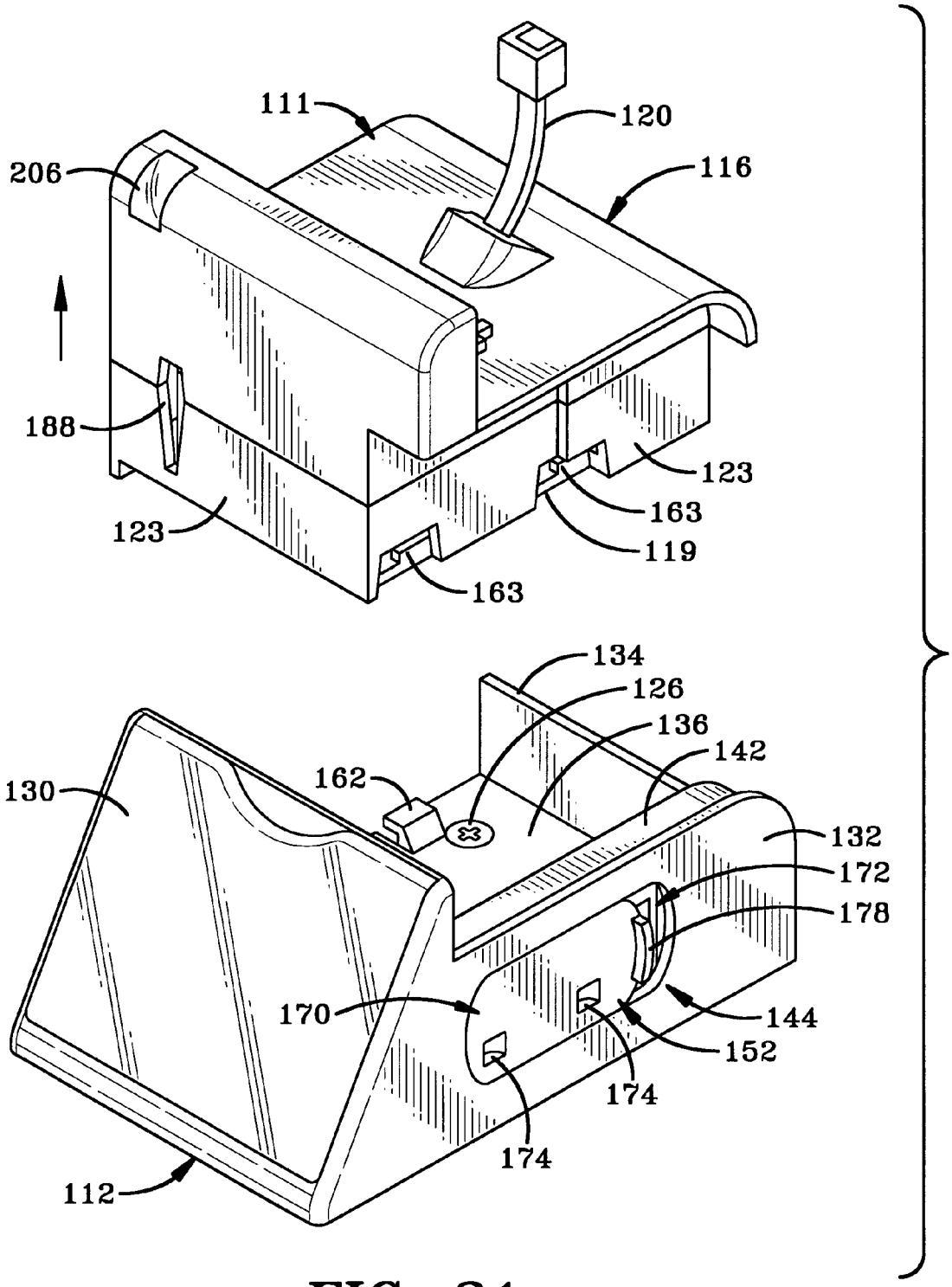
FIG. 31 is a perspective view of the alarm unit being lifted from the base.
Figure 32:
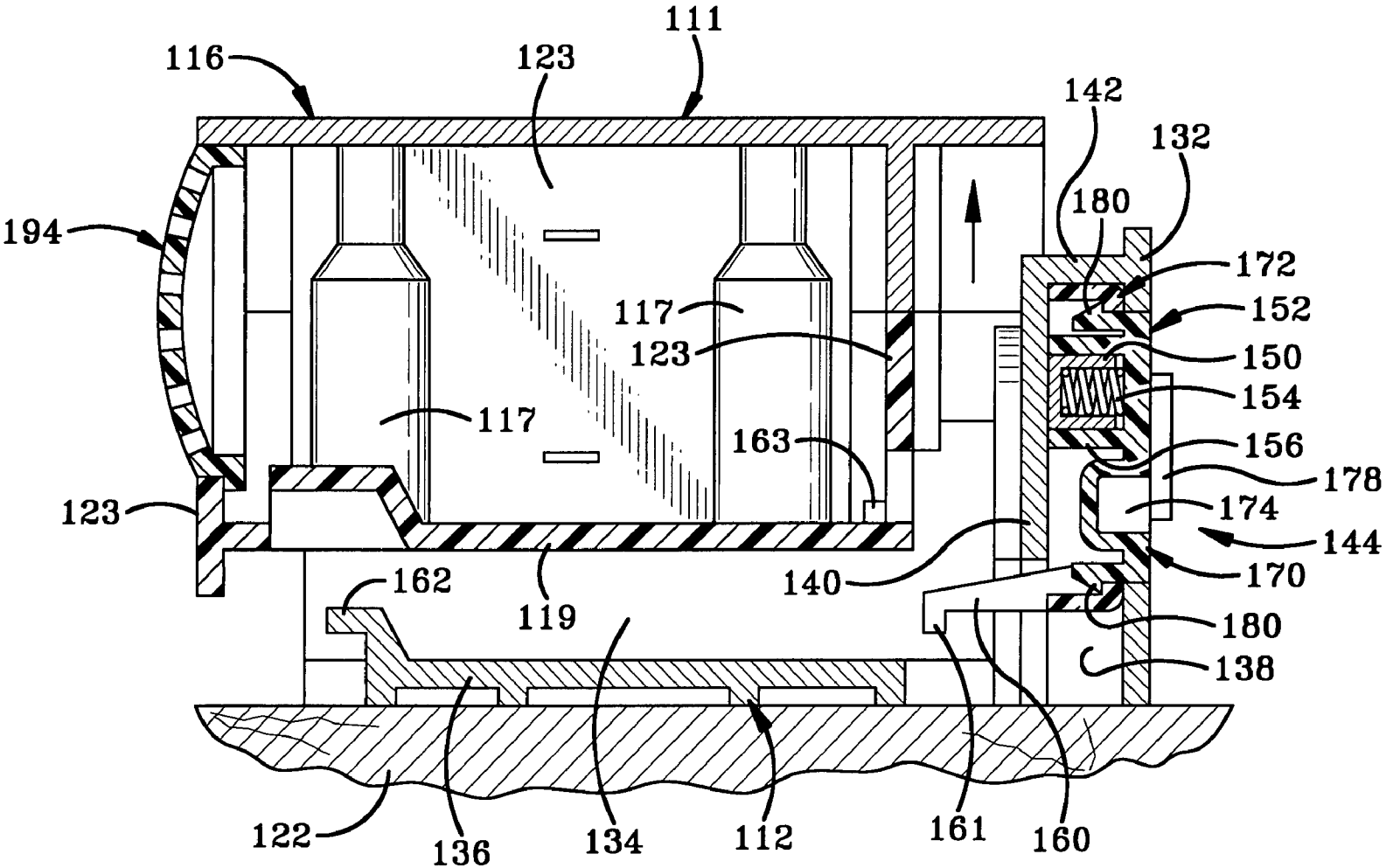
FIG. 32 is a section view similar to FIG. 30 showing the alarm unit being lifted from the base.

Moveable lock element 152 includes at least one lock ledge 160 that extends through inner lock wall 140 into the enclosure defined by base 112 that receives alarm unit 116 (FIGS. 17, 19 and 30). Each lock ledge 160 projecting from moveable lock element 152 lockingly engages alarm unit 116 when alarm unit 116 is in the locked position with respect to base 112 and moveable lock element 152 is in the locked position. Each lock ledge 160 may include a hooked end 161 that helps lock alarm unit 116 in place by engaging a retaining block 163 when in the locked position of FIGS. 17 and 19. Although lock ledges 160 may be used alone to lock alarm unit 116 with respect to base 112, the exemplary embodiment of the invention includes at least one fixed lock ledge 162 projecting upwardly from bottom wall 136 of base 112. In the exemplary embodiment, four lock ledges 160/162 are used to lock alarm unit 116 to base 112.

Moveable lock element 152 may be assembled from a first portion 170 that is snap fit to a second portion 172 for assembly purposes. Moveable lock element 152 includes a pair of key prong openings 174 that properly position first key 146. Key prong openings 174 also allow key 146 to move moveable lock element 152 from the locked position to the unlocked position when key prongs 176 are inserted into openings 174. First element 170 may include a step 178 that allows the user to manually push moveable lock element 152 to the locked position. Step 178 also helps position key 146 with respect to lock element 152.

In this embodiment, moveable lock ledges 160 project from the inner surface of second element 172. Sleeves 156 project inwardly from the inner surface of first element 170. Elements 170 and 172 are held together with a snap together connection formed by fingers 180. If base 112 is molded as a single integral unit, second element 172 may be fit into cavity 138 through the opening in outer side wall 132. In another embodiment, inner wall 140 may define a single large opening for moveable lock ledges 160 that allows second element 172 to be pivoted upwardly into cavity 138 through the opening.

Figure 28:
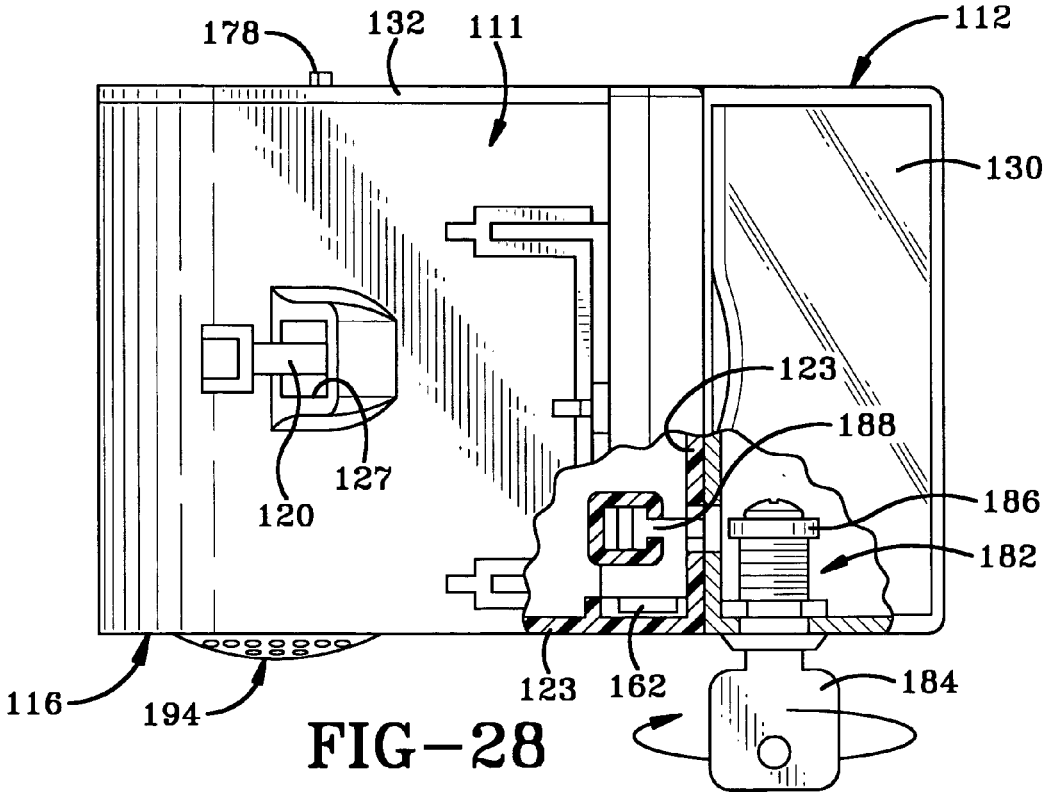
FIG. 28 is a view similar to FIG. 26 showing the second lock in the unlocked position.
Figure 29:
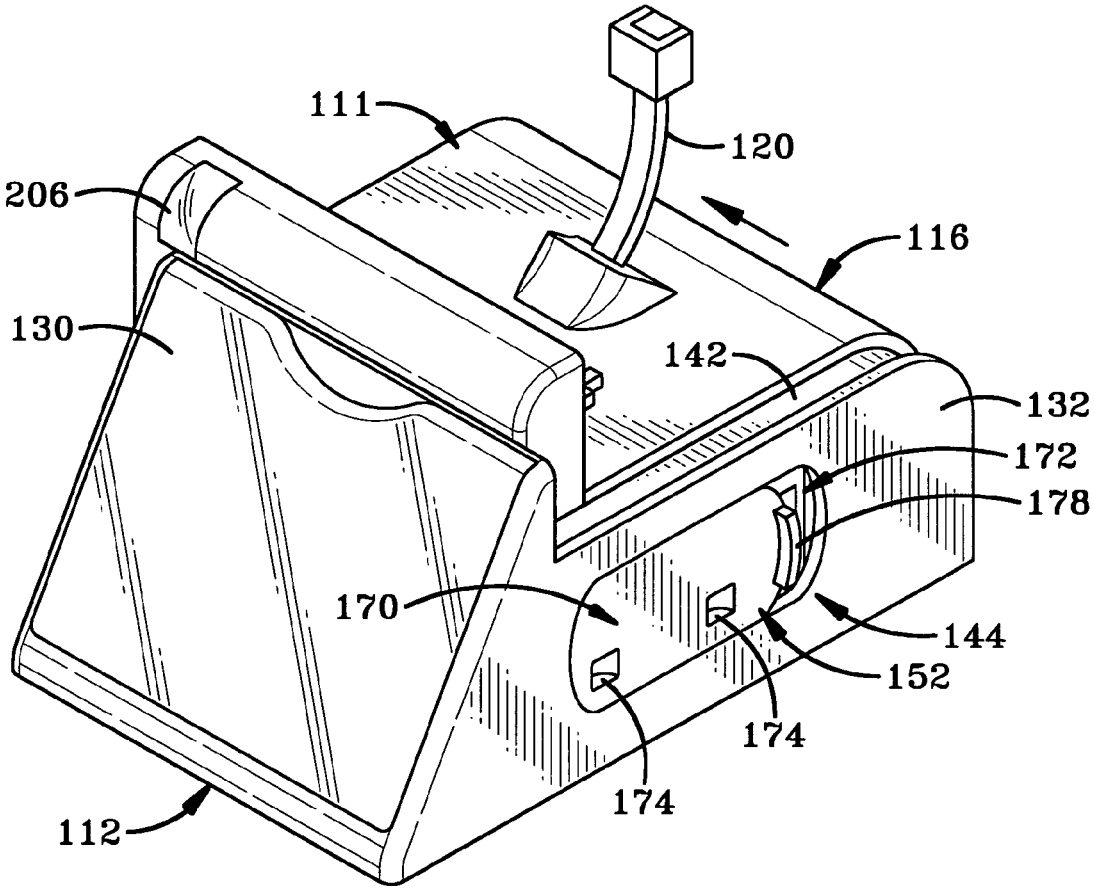
FIG. 29 is a perspective view of the base and alarm unit with the alarm unit being slid out of the locked position from the base.

System 100 may include a second lock 182 (optionally because the first lock will secure the system) that uses a second key 184 different from first key 146. In the exemplary embodiment, a mechanically key 184 is used to lock and unlock second lock 182. When second lock 182 is used with system 100, both keys 146 and 184 are needed to remove alarm unit 116 from base 112. In the exemplary embodiment, lock 182 rotates an arm 186 from a locked position (FIG. 26) to an unlocked position (FIG. 28). In the locked position, arm 186 extends into an opening or recess 188 defined by alarm unit 116 to retain alarm unit 116 to base 112. Arm 186 thus forms an interference fit with alarm unit 116 when arm 186 is in the locked position.

Figure 6:
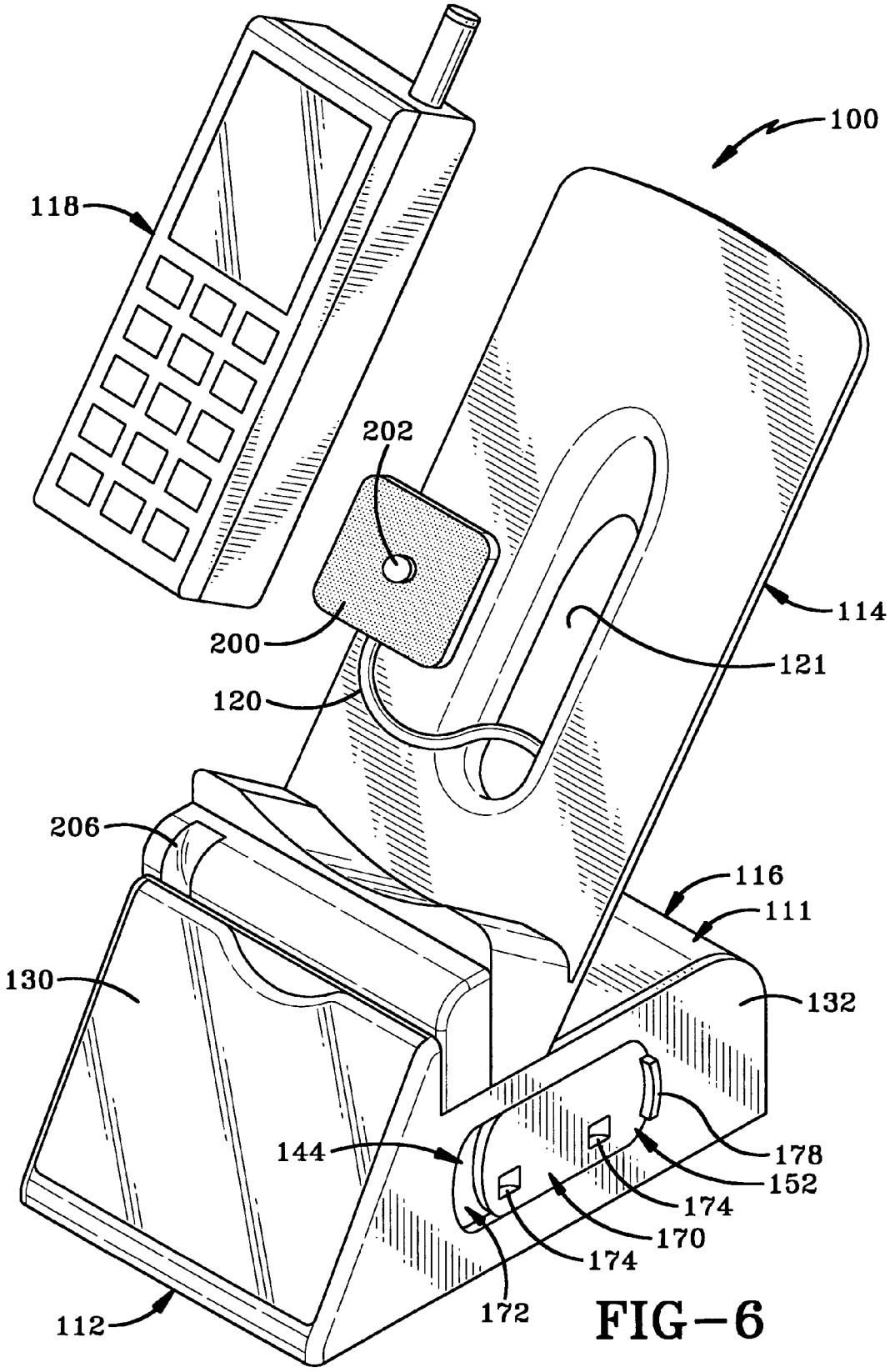
FIG. 6 is a perspective view of a second embodiment of the alarming display system made in accordance with the concepts of the present invention.
Figure 7:
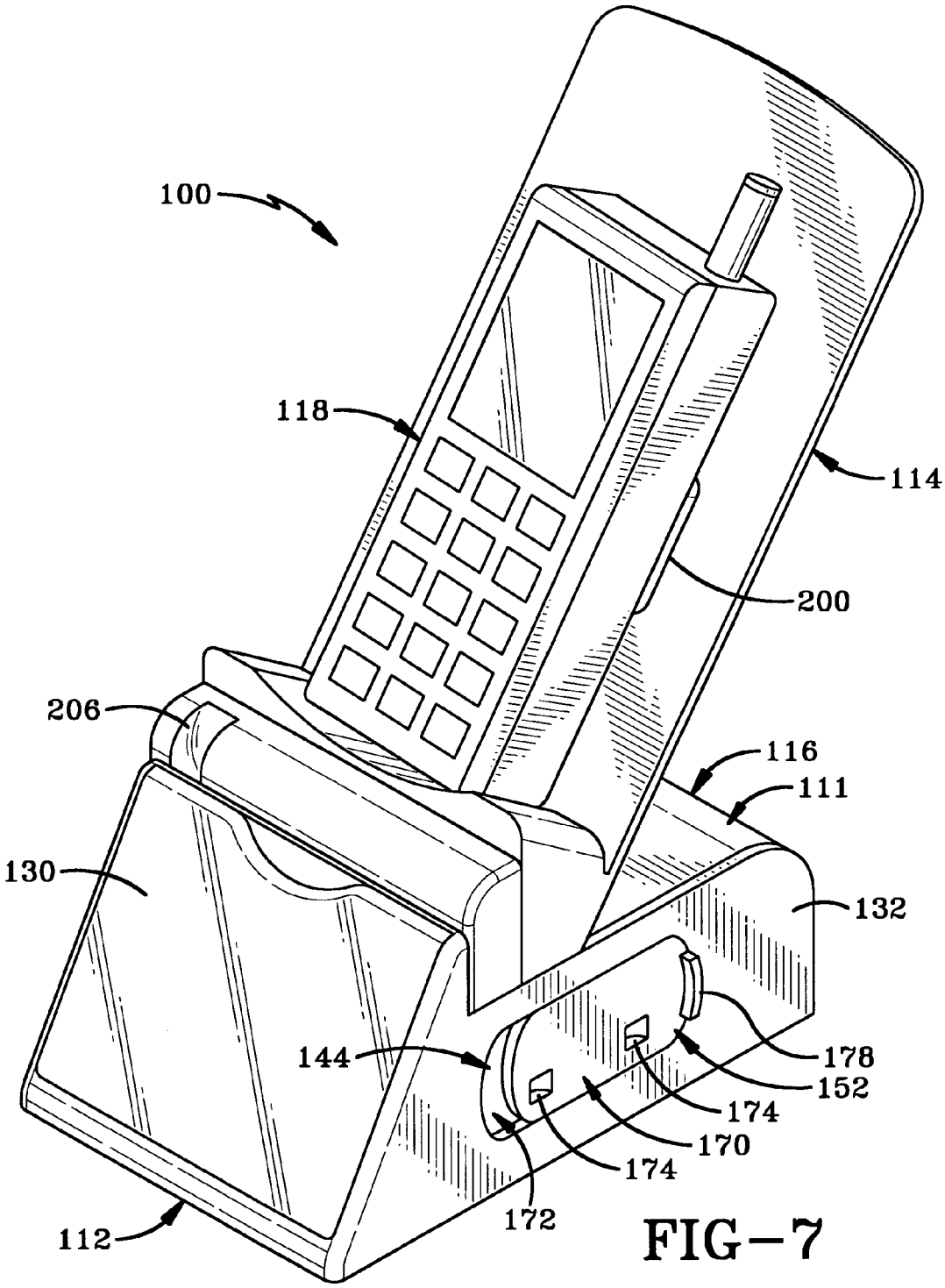
FIG. 7 is a view similar to FIG. 6 showing the item of merchandise secured to the alarming display system and resting in the shelf.
Figure 8:
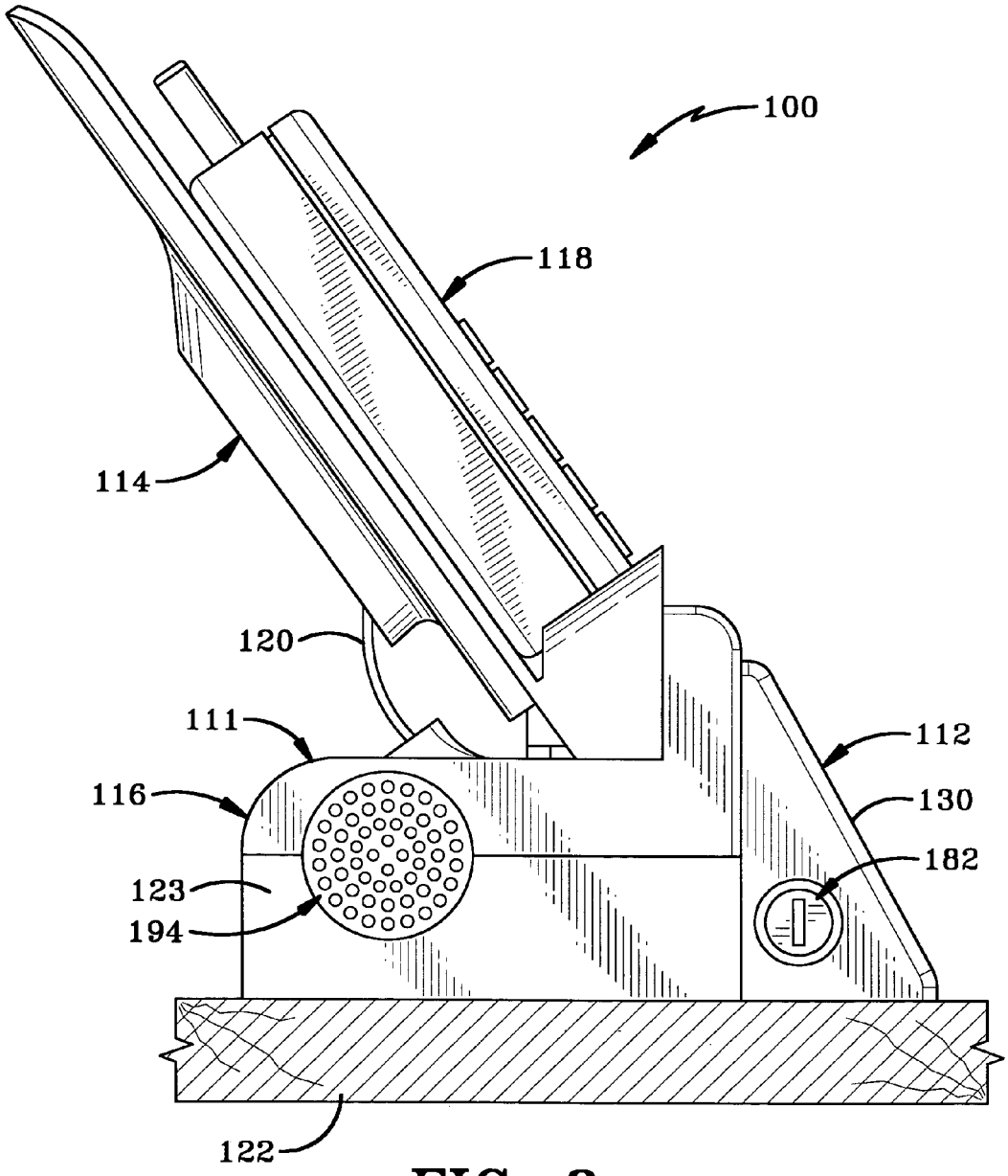
FIG. 8 is a left side elevation view of FIG. 7.
Figure 9:
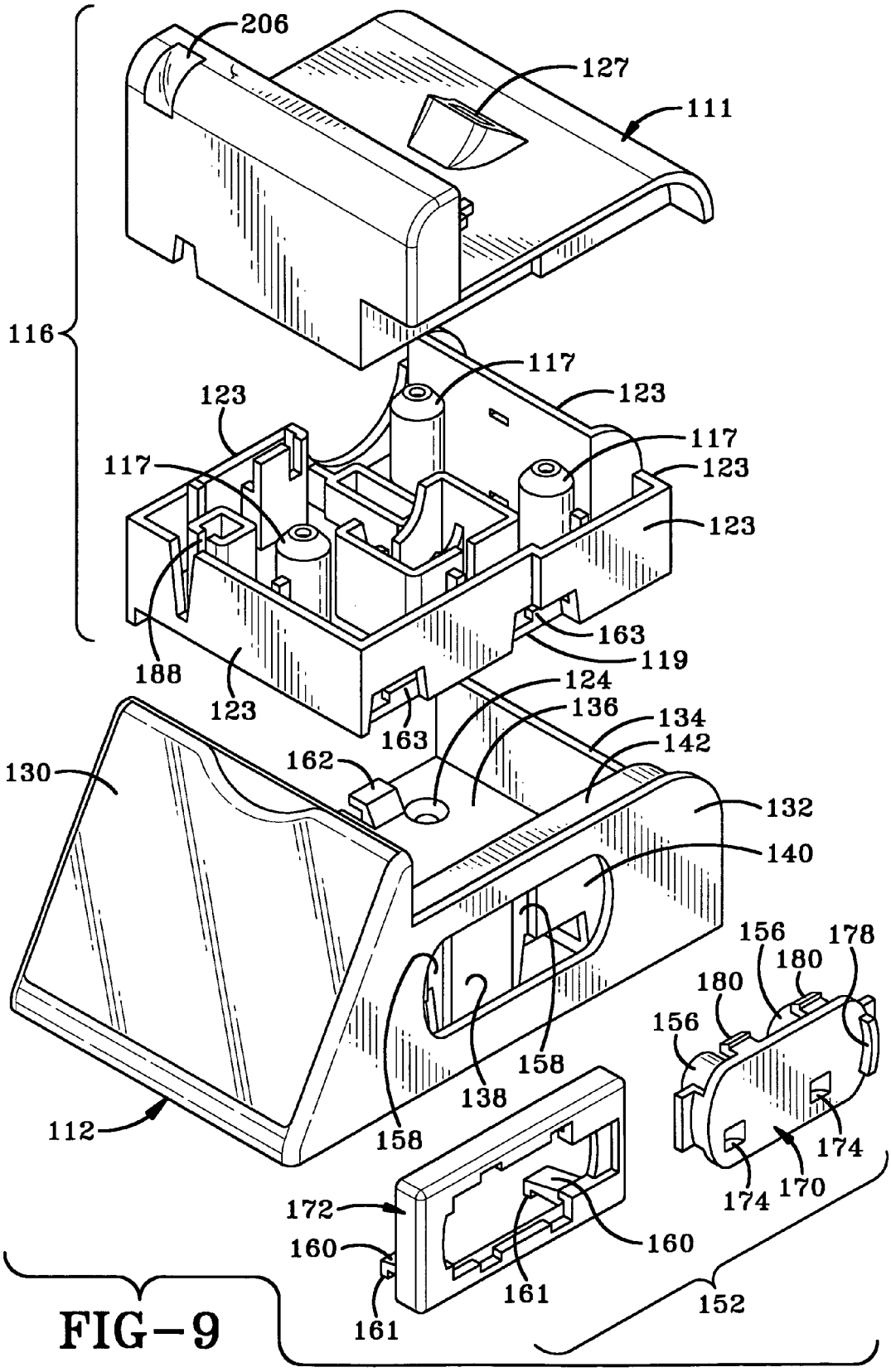
FIG. 9 is an exploded view of the base and alarm unit of FIG. 8.
Figure 10:
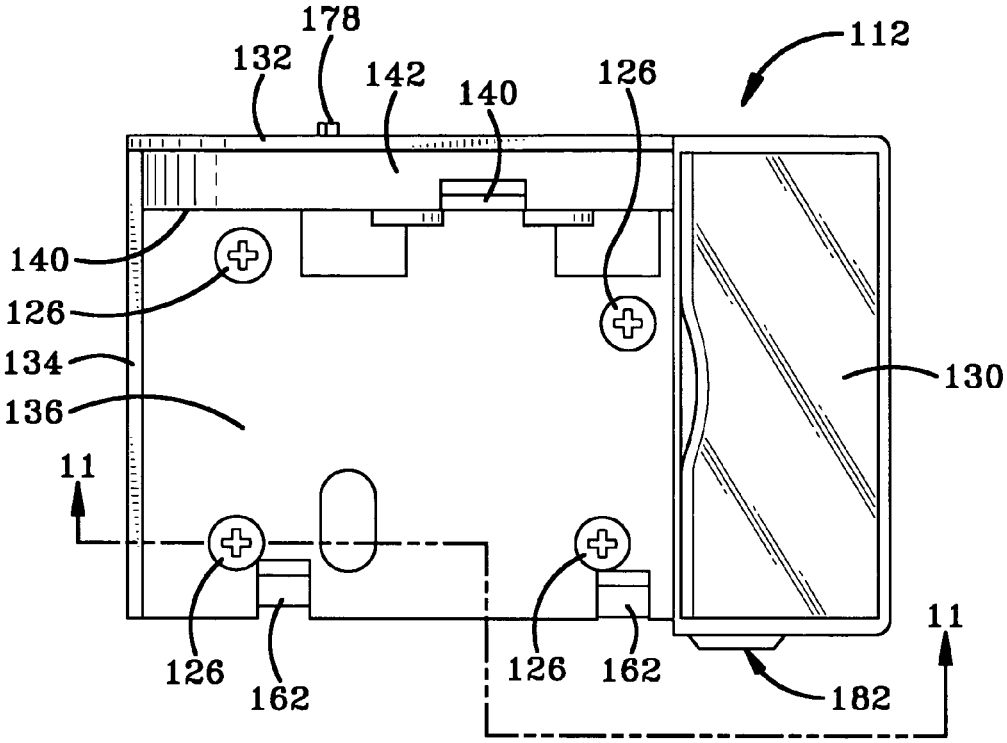
FIG. 10 is a bottom plan view of the base.
Figure 14:
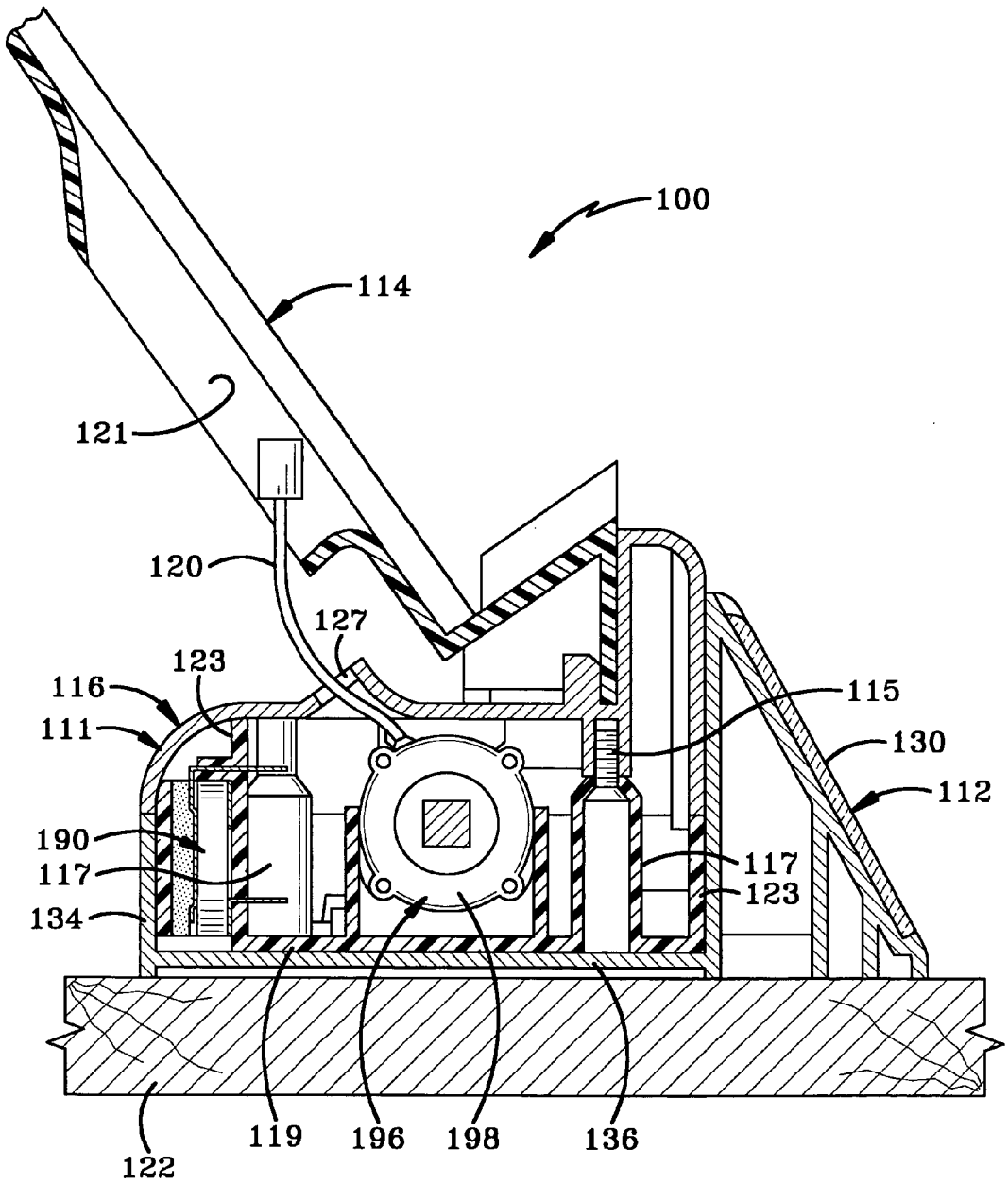
FIG. 14 is a section view taken along line 14—14 of FIG. 12.
Figure 15:
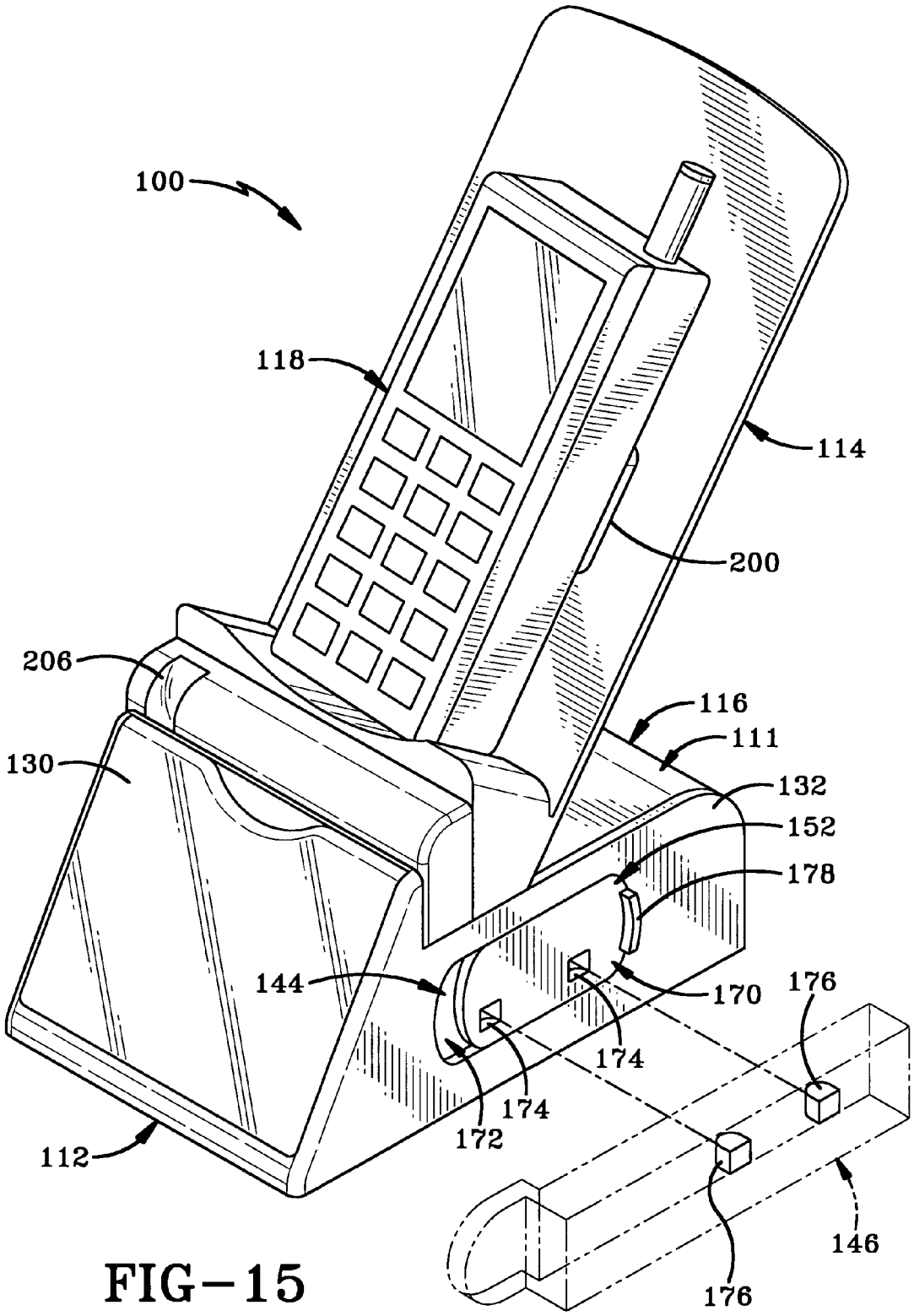
FIG. 15 is a perspective view similar to FIG. 7 showing the key prongs of a first key being aligned with key prong openings in a first lock.

Alarm unit 116 is a self-contained alarm system that includes its own power source 190 (FIG. 12) (optionally, a power cord may be used to power system 100), alarm circuitry 192, alarm indicator 194, and alarm tether 196. Alarm unit 116 thus does not need to be attached to exterior alarm systems for system 100 to protect merchandise 118. In the exemplary embodiment, power source 190 is a battery, the alarm indicator 194 is a speaker and/or a light, and alarm tether 196 includes a retractor 198 and alarm cable 120 (FIG. 14). Cable 120 has an outer end that is connected to item 118 with a self-adhesive sensor 200 having a plunger switch 202 that creates a signal when sensor 200 is removed from item 118 (FIG. 6). Retractor 198 includes a spring-loaded coil and a swivel. The coil is adapted to automatically rewind cable 120 after cable 120 has been unwound. The swivel allows the electric cables to exit the coil without twisting.

Alarm unit 116 also includes at least one alarm switch 204 (FIG. 12) that arms and disarms the alarm system. In the exemplary embodiment, first lock 144 is used to trip alarm switch 204. Thus, first key 146 must be used to arm and disarm the alarm system. Lock 144 is shown tripping switch 204 in FIG. 21. Switch 204 is thus tripped every time lock 144 is moved to the unlocked position as shown by Arrow A. In an alternative embodiment, switch 204 may be tripped by second lock 182. In another alternative embodiment, both locks 144 and 182 may be monitored with alarm switches. In a further alternative embodiment, a third unique key may be used to disarm the alarm system with or without the cooperation of the first and/or second keys. If the alarm is set off by a shoplifter or by a customer, alarm switch 204 is used to turn the alarm off.

In one optional embodiment of the invention, an indicator light 206 (FIG. 25) may be used to show the user the status of the alarm system. When light 206 is on, the user knows that the alarm system is on. The alarm system is off when light 206 is off.

The particular circuitry interconnecting the various components of the display system such as cables 20, 120, plunger 70, 202, alarm switch 204, etc. for providing an audible, visual, or silent alarm can have various configurations well known to those skilled in the art, and thus is not shown in detail.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A display system for displaying items of merchandise in a retail environment; the display system comprising:

a base;

a shelf;

an alarm unit;

the shelf being locked to the base by the alarm unit.

2. The display system of claim 1, wherein the alarm unit includes a plunger that is activated when the alarm unit is removed from the base.

3. The display unit of claim 1, wherein the alarm unit includes an arm that is disposed through openings formed in the base and shelf when the alarm unit is in a locked position.

4. The display unit of claim 1, wherein the base includes a leg that is locked to the alarm unit when the alarm unit is in a locked position.

5. The display unit of claim 1 wherein the alarm unit is selectively locked to the base with a first lock and a second lock.

6. The display system of claim 5, wherein the first lock is magnetically-actuated and the second lock is mechanically actuated.

7. The display unit of claim 5 wherein the alarm unit is in communication with an alarm switch and is in an activated position when the first lock is in a locked position, and wherein the alarm switch is deactivated when the first lock is in an unlocked position.

8. The display unit of claim 1 including an alarm cable having an outer end adapted to be connected to an item of merchandise; and wherein the alarm unit is activated if the cable is cut.

9. The display unit of claim 8 wherein the alarm unit is activated if the outer end of the cable is removed from the item of merchandise.

10. The display unit of claim 1 wherein the base is adapted to be secured to a support structure at the retail establishment with at least one connector.

11. The display unit of claim 10 wherein the alarm unit covers a portion of the connector that holds the base to the support structure when the alarm unit is locked to the base.

12. The display system of claim 1, wherein the shelf is secured to the alarm unit by an alarm cable.

13. The display system of claim 12, wherein the alarm cable includes a plunger which is actuated when the cable is attached to an item of merchandise.

14. The display system of claim 12 wherein the alarm cable extends through an opening formed in the shelf and has a sensor attached at an outer end of said cable preventing removal of the shelf from the base.

15. The display system of claim 1 wherein the alarm unit is locked to the base with a first lock slideable between locked and unlocked positions on the base; and in which said first lock includes at least one lock finger moveably engageable between locked and unlocked positions with the base.

16. The display system of claim 15 wherein the lock finger is spring biased toward the locked position with the base.

17. The display system of claim 15 wherein the first lock includes at least one lock ledge which extends through an inner lock wall of the base and engages the alarm unit when the alarm unit is in the locked position with the base.

18. The display system of claim 15 wherein the first lock includes at least one opening which aligns with the lock finger for receiving a key prong to move the lock finger to an unlocked position.

19. The display system of claim 1 wherein the alarm unit includes a power source, alarm circuitry, a retractable alarm cable, and an alarm indicator.

20. The display system of claim 19 wherein the alarm indicator is an audible or visual alarm.

21. The display system of claim 1 wherein the alarm unit is locked to the base by a plurality of biased locking fingers magnetically attractable toward an unlocked position.

* * * * *